US006921149B2

(12) United States Patent
Okuda et al.

(10) Patent No.: US 6,921,149 B2
(45) Date of Patent: Jul. 26, 2005

(54) LIQUID DROP DISCHARGING HEAD AND LIQUID DROP DISCHARGING DEVICE

(75) Inventors: Masakazu Okuda, Ebina (JP); Ryuichi Kojima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 23 days.

(21) Appl. No.: 10/600,698

(22) Filed: Jun. 23, 2003

(65) Prior Publication Data

US 2004/0041881 A1 Mar. 4, 2004

(30) Foreign Application Priority Data

Sep. 2, 2002 (JP) ..... 2002-256307

(51) Int. Cl.[7] ..... B41J 2/15
(52) U.S. Cl. ..... 347/40
(58) Field of Search ..... 347/40, 43, 65, 347/68, 71, 85; B41J 2/145, 2/15

(56) References Cited

U.S. PATENT DOCUMENTS

| | | | | |
|---|---|---|---|---|
| 3,946,398 A | | 3/1976 | Kyser et al. | 347/70 |
| 4,223,323 A | * | 9/1980 | Bader et al. | 347/85 |
| 4,611,219 A | * | 9/1986 | Sugitani et al. | 347/40 |
| 6,471,317 B2 | * | 10/2002 | Chang | 347/9 |
| 6,712,454 B2 | * | 3/2004 | Okuda | 347/65 |

FOREIGN PATENT DOCUMENTS

| | | | | |
|---|---|---|---|---|
| EP | 1186414 A2 | * | 3/2002 | B41J/2/14 |
| JP | 53-12138 B | | 4/1978 | |
| JP | 1-208146 | | 8/1989 | |
| JP | 9-156095 | | 6/1997 | |
| JP | 10-193587 | | 7/1998 | |
| JP | 10-508808 | | 9/1998 | |
| WO | WO97/28000 | | 8/1997 | |

* cited by examiner

*Primary Examiner*—Lamson Nguyen
*Assistant Examiner*—Blaise Mouttet
(74) *Attorney, Agent, or Firm*—Morgan Lewis & Bockius LLP

(57) ABSTRACT

A liquid drop discharging head includes a matrix array head that can reduce variations in a print density without reducing a recording speed. A liquid drop discharging device provided with this liquid drop discharging head can realize compatibility between recording an image at high speed and recording the high quality image. Ejectors are disposed alternately to form dots on a recording medium that are arranged in the order of alternating ejectors such as A, E, B, F, C, G, D, and H. The dots having a relatively large diameter and the dots having a relatively small diameter are mixedly disposed in a sub-scanning direction at predetermined pitches. Mixed arrangement of dots increases space frequency variations in a print density along the sub-scanning direction, thus, making it difficult for the human eye to sense the density variations, and ensuring a high uniformity in a recorded result.

20 Claims, 18 Drawing Sheets

LIQUID DROP DISCHARGING HEAD AND LIQUID DROP DISCHARGING DEVICE

CROSS-REFERENCE TO RELATED APPLICATION

This application claims priority under 35USC 119 from Japanese Patent Application No. 2002-256307, the disclosure of which is incorporated by reference herein.

BACKGROUND OF THE INVENTION

1. Field of the Invention

The present invention relates to a liquid drop discharging head and a liquid drop discharging device and, in particular, to a liquid drop discharging head that discharges liquid drops to record letters and images on a recording medium or to form fine patterns and thin films on a substrate and a liquid drop discharging device provided with this liquid drop discharging head.

2. Description of the Related Art

A liquid drop discharging method has been generally well known for generating a pressure wave (acoustic wave) in a liquid filled in a pressure developing chamber by pressure developing means such as a piezoelectric actuator and for discharging liquid drops from nozzles connected to the pressure developing chamber by the pressure wave. In particular, an ink jet recording device has been widely used that discharges drops of ink to record letters and images on recording paper (for example, Japanese Patent Application Publication (JP-B) No. 53-12138 and Japanese Patent Application Laid-Open (JP-A) No. 10-193587). In recent years, an image of extremely high quality can be recorded by reducing the volume of a drop of ink and by the use of ink of a low concentration.

Moreover, in recent years has been tried an industrial application of a liquid drop discharging device using the above liquid drop discharging method. Main applications include:

(a) an electrically conducting polymer solution is discharged onto a substrate to form a wiring pattern and a transistor;

(b) an organic EL solution is discharged onto a substrate to form an EL display panel;

(c) fused solder is discharged onto a substrate to form electrical mounting bumps;

(d) liquid drops of UV cure resin or the like are laminated and cured on a substrate to form a three-dimensional body; and (e) an organic material solution (resist solution or the like) is discharged onto a substrate to form an organic thin film.

In this manner, the liquid drop discharging device has been utilized not only in recording images but also in extensive fields. It is expected that the liquid drop discharging device will be utilized in more extensive fields in the future.

Incidentally, in the following, an object onto which liquid drops are discharged from a liquid drop discharging head is called "a recording medium" and a dot pattern on a recording medium formed by the liquid drops adhering to the recording medium is called "an image" or "a recorded image". Therefore, "the recording medium" in the following description includes not only a recording sheet and an OHP sheet but also, for example, the substrate described above and the like. Moreover, "the image" in the following description includes not only a general image (letter, picture, photograph), but also the wiring pattern, the three-dimensional body, the organic thin film, which have been described above, and the like.

An example of a liquid drop discharging mechanism (ejector) in a liquid drop discharging device publicly known in the above patent gazette or the like is shown in a cross-sectional view in FIG. 13. A nozzle 16 for discharging a liquid drop and a supply passage 20 for guiding liquid from a liquid tank (not shown) through a common passage 18 are connected to a pressure developing chamber 14. Moreover, a vibration plate 22 is fixed to the bottom of the pressure developing chamber 14. When a liquid drop is discharged, the vibration plate 22 is displaced by a piezoelectric actuator 24 mounted on an opposite side of the pressure developing chamber 14 with the vibration plate 22 sandwiched between them to change the volume of the pressure developing chamber 14 thereby to develop a pressure wave. This pressure wave ejects out a part of liquid filled in the pressure developing chamber 14 through the nozzle 16 to fly a liquid drop 26. The flied liquid drop 26 attaches to a recording medium such as recording paper and forms a dot (pixel). By repeating the formation of the dot in this manner based on image data or the like, a pattern such as a letter, an image or the like is recorded (formed) on the recording medium.

In the liquid drop discharging device described above, it is an improvement in a recording speed that presents a significant challenge at present. In the liquid drop discharging device, the largest parameter affecting the recording speed is the number of nozzles and as the number of nozzles increases, the number of dots to be formed in a unit time increases and the recording speed increases. For this reason, in an ordinary liquid drop discharging device, a multi-nozzle type liquid drop discharging head (linear array head) is widely employed in which a plurality of ejectors are connected to each other.

A linear array head 32 is shown in FIG. 14 as an example of the multi-nozzle type liquid drop discharging head. In this linear array head 32, a liquid tank (not shown) is connected to a common passage 36 through a liquid supply port 34 and a plurality of ejectors 38 are connected to this common passage 36.

However, in a structure in which the ejectors 38 are arranged one-dimensionally (linearly), the number of ejectors cannot be so much increased (usually, the maximum number of ejectors is about 100).

Then, some liquid drop discharging heads have been proposed until now in which the number of ejectors is increased by two-dimensionally arranging the ejectors in the form of matrix (hereinafter referred to as "matrix array head)(JP-A Nos. 1-208146 and 9-156095).

Examples of basic structure of a conventional matrix array head are shown in FIGS. 15A and 16A, respectively.

In these matrix array heads 42 and 52, a plurality of ejectors 44 are connected to each common passage 46 and further a plurality of common passages 46 are connected to a second common passage 48. For example, in the matrix array head 42 shown in FIG. 15A, the common passages 46 are arranged along a main scanning direction (shown by an arrow M) of the head and the second common passage 48 is arranged along a direction perpendicular to the main scanning direction (sub-scanning direction, shown by an arrow S). The respective ejectors (44A to 44H) connected to the same common passage 46 are shifted by pitches Pn in the sub-scanning direction. In a process of scanning the head in the main scanning direction, by discharging liquid drops from the respective ejectors while controlling a discharging timing, dots 50 are formed at the pitches shown in FIG. 15B.

On the other hand, in the matrix array head 52 shown in FIG. 16A, the common passages 46 are arranged along the sub-scanning direction (shown by an arrow) of the head and the second common passage 48 is arranged along the main scanning direction. Also in this case, the respective ejectors arranged adjacent to each other are shifted by the pitches Pn in the sub-scanning direction. In a process of scanning the head in the main scanning direction, by discharging liquid drops from the respective ejectors while controlling a discharging timing, dots 50 are formed at the pitches Pn shown in FIG. 16B.

The matrix array head having such a structure is very advantageous to recording an image at high speeds because the number of ejectors can be increased. For example, in the matrix array head 42 shown in FIG. 15A, if the number of common passages 46 is 26 and 10 ejectors 44 are connected to each of the common passages 46, 260 ejectors can be arranged (in FIG. 15A, the number of common passages 46 is 8 and 8 ejectors are connected to one common passage 46 and hence only a total of 64 ejectors 44 are shown).

However, the conventional matrix array head described above is advantageous to a high-speed recording, whereas it presents a problem that it is difficult to provide high uniformity in a recorded result. To be specific, the conventional matrix array head raises a problem that it tends to produce cyclical variations in a print density (variations in dot diameter) in a direction perpendicular to the main scanning direction of the head (sub-scanning direction) and hence significantly impairs uniformity in the recorded result.

Although the reason why such variations in the print density are easily caused in the matrix array head is variously considered, in many cases, the variations in the print density are particularly caused by the fact that the discharging characteristics (volume and speed of the liquid drop) of the ejector tend to vary according to the positions where the ejectors are connected to the common passage.

That is, in the matrix array head, the respective ejectors are connected to a long slender common passage, so that the characteristics (passage resistance and inertance) of the common passage when viewed from the respective ejectors vary according to the positions where the ejectors are connected to the common passage. For example, in FIG. 15A, the effective length (Lc) of the common passage becomes small for the ejector 44A connected to the base portion of the common passage 46, so that the passage resistance and inertance of the common passage 46 also become small (the passage resistance and the inertance are proportional to a passage length). On the other hand, for the ejector 44H connected to the tip portion of the common passage 46, the effective length (Lc') of the common passage becomes large, so that the passage resistance and inertance of the common passage 46 also become large. The passage resistance and inertance of the common passage 46 significantly affects the refill characteristics (which will be described later) of the respective ejectors and, as a result, change discharging characteristics (volume and speed of the liquid drop) of the respective ejectors 44. For this reason, differences are produced in the discharging characteristics between the respective ejectors 44, depending on the positions where the ejectors are connected to the common passage 46.

In FIG. 15B is schematically shown an effect that the above-mentioned differences in the discharging characteristics between the ejectors have on the uniformity in the recorded result. Here, description will be made in the following on the assumption that the ejector connected to the base portion of the common passage 46 has a large liquid drop volume (dot diameter) and the ejectors connected to the portions nearer to the tip of the common passage 46 have smaller liquid drop volumes (dot diameters), which is a tendency generally observed in this matrix array head. (However, depending on the passage resistance and inertance of the common passage, there are cases where the ejector connected to the base portion of the common passage 46 has a small liquid drop volume (dot diameter) and the ejectors connected to the portions nearer to the tip of the common passage 46 have larger liquid drop volumes (dot diameters). Further, there are cases where the liquid drop volume (dot diameter) has a complex tendency, for example, the liquid drop volume (dot diameter) decreases or increases as the positions of the ejectors come nearer to the both ends (base portion and tip portion) from the center of the common passage 46).

In a case where there is the above-mentioned difference (distribution) in the liquid drop volume, in a line of recorded dots, as shown in FIG. 15B, the dot diameter changes in a cycle of n (where n is the number of ejectors connected to one common passage 46 and in the case shown in FIG. 15*b*, $n$=8). In short, variations in the print density having a cycle of n are caused in the sub-scanning direction in the recorded result. In the general matrix array head, n is set at about 4 to 20 and a recording resolution in the sub-scanning direction is set at about 150 to 600 dpi (dot/inch) and hence the cycle of the above-mentioned variations in the print density become about 0.17 to 3.4 mm. That is, the general matrix array head causes the variations in the print density having a space frequency of 0.3 to 5.9 cycle/mm.

In FIG. 17, human eye's sensitivity to variations in the print density is shown in a graph with a horizontal axis as the space frequency. It can be found from this graph that when the space frequency of variations in the print density is 6 or less cycle/mm, the human eye's sensitivity to variations in the print density increases and human eyes can easily sense variations in the print density. In particular, in a case where the space frequency is not larger than 3 cycle/mm, the human eye can extremely easily sense variations in the print density. Here, for the space frequency not larger than 1 cycle/mm, there exist both of data (broken line) showing that the sensitivity decreases and data (solid line) showing the sensitivity does not decrease, but according to experimental results obtained by the inventors, it is said that the data shown by the solid line well express the actual sensitivity of the human eyes.

With consideration given to human eye's characteristics, variations in the print density having a space frequency of 0.3 to 5.9 cycle/mm caused by the conventional matrix array head are those very easily sensed by the human eyes, which results in significantly impairing the quality of the recorded result. In order to make the human eyes become hard to sense variations in the print density, it is necessary that the space frequency of variations in the print density be set at 6 or more cycle/mm, preferably, 10 or more cycle/mm. However, by the conventional multi-nozzle array head, it is difficult to realize this space frequency and thus it is impossible to perform a highly uniform recording.

Moreover, even in a case where the passage arrangement shown in FIG. 16A, there is presented a problem that variations in the print density are caused by the positions where the ejectors are connected to the common passage. In a case where such passage arrangement is employed, the cycle of variations in the print density becomes a head length (LH) in the sub-scanning direction and hence variations in the print density become very large. For example, in a case where a recording resolution in the sub-scanning direction is 300 dpi and the number of ejectors is 260, the head length in the sub-scanning direction becomes about 22 mm and hence the cycle of variations in the print density becomes about 22 mm (the space frequency becomes about 0.05 cycle/mm). Variations in the print density having such a low frequency are also very easily sensed by the human eyes, thereby impairing the uniformity of the recorded result.

As described above, in the conventional matrix array head, variations in the print density tends to be caused in the direction perpendicular to the main scanning direction of the head (sub-scanning direction) by the difference in the discharging characteristics between the respective ejectors. These variations in the print density become noticeable particularly in a case where the ejectors are to be arranged at high density. This is because since the width of the common passage is required to be set very small so as to increase the arrangement density of the ejectors, the passage resistance and the inertance of the common passage increase, which results in inevitably increasing the differences in the discharging characteristics between the respective ejectors that are caused by the positions where the ejectors are connected to the common passage. In other words, as the number of nozzles (nozzle density) is increased so as to increase a recording speed, the quality of recorded result tends to be degraded and hence it is extremely difficult to realize compatibility between high-speed recording and high-quality recording.

Here, in JP-B No. 10-508808 is disclosed the matrix array head 62 shown in FIG. 18.

In this matrix array head 62, passages 64 correspond to the common passages 46 shown in FIG. 15A. The passages 64 are arranged along the direction perpendicular to the main scanning direction M of the matrix array head 62 (sub-scanning direction S). Moreover, passages 66 corresponding to the second common passage 48 shown in FIG. 15A are arranged at two portions of the top and bottom portions of a group of ejectors 70 constructed of a plurality of ejectors 68. The passages 64 connected to each of the passages 66 are arranged alternately in the main scanning direction. The respective ejectors 68 are connected to each other through two adjacent passages 64 and a supply passage 72. With this method of arranging the passages 64 and this method of connecting ejectors 68, it is possible to prevent the occurrence of the above-mentioned variations in the print density and hence to perform highly uniform recording.

However, in a case of this matrix array head 62, there is presented a problem that since the common passages (passages 64) need to be arranged in such a way as to pass through the group of ejectors 70 in the sub-scanning direction, the length of the group of ejectors cannot be elongated in the sub-scanning direction and hence this matrix array head 62 cannot respond to high-speed recording. That is, if the ejectors 68 are increased in number so as to realize high-speed recording, the length of the group of ejectors (head length) is increased in the sub-scanning direction and hence the total length of the common passages (passages 64) is very much increased. As a result, the passage resistance of the passage 64 is very much increased, so that even if the passage arrangement shown in FIG. 18 is used, it is impossible to realize highly uniform recording (or presents a problem of increasing the size of the head).

SUMMARY OF THE INVENTION

The present invention has been made to solve the above-mentioned problems. It is the object of the invention to provide a liquid drop discharging head that can reduce variations in a print density easily caused by a matrix array head without reducing a recording speed and can realize compatibility between high speed recording and high quality recording and a liquid drop discharging device provided with this liquid drop discharging head.

In order to achieve the above object, according to the first aspect of the invention, there is provided a liquid drop discharging head comprising at least one ejector unit arranged along a main scanning direction, wherein each ejector unit includes a first ejector group arranged at one side in the main scanning direction and a second ejector unit arranged at another side in the main scanning direction, each ejector group includes a plurality of ejectors, all of the ejectors are arranged two-dimensionally in a predetermined plane, each ejector includes at least one nozzle, all of the nozzles are offset from each other in a sub-scanning direction which is substantially perpendicular to the main scanning direction, the nozzles of each ejector group are alternately arranged so that when they are viewed in the main scanning direction, a nozzle of one ejector of the first ejector group, a nozzle of one ejector of the second ejector group, a nozzle of another ejector of the first ejector group, a nozzle of another ejector of the second ejector group, and so on are arranged in this order along the sub-scanning direction.

Further, according to the second aspect of the invention, there is provided a liquid drop discharging device comprising: a liquid drop discharging head for applying a liquid drop to an object; and a main scanning mechanism for relatively moving the object and the liquid drop discharging head in a main scanning direction, wherein the liquid drop discharging head includes at least one ejector unit arranged along the main scanning direction, each ejector unit including a first ejector group arranged at one side in the main scanning direction and a second ejector group arranged at another side in the main scanning direction, each ejector group includes a plurality of ejectors, all of the ejectors are arranged two-dimensionally in a predetermined plane, each ejector includes at least one nozzle, all of the nozzles are offset from each other in a sub-scanning direction which is substantially perpendicular to the main scanning direction, the nozzles of each ejector group are alternately arranged so that when they are viewed in the main scanning direction, a nozzle of one ejector of the first ejector group, a nozzle of one ejector of the second ejector group, a nozzle of another ejector of the first ejector group, a nozzle of another ejector of the second ejector group, and so on are arranged in this order along the sub-scanning direction.

DETAILED DESCRIPTION OF THE INVENTION

Figures 1A, 1B:
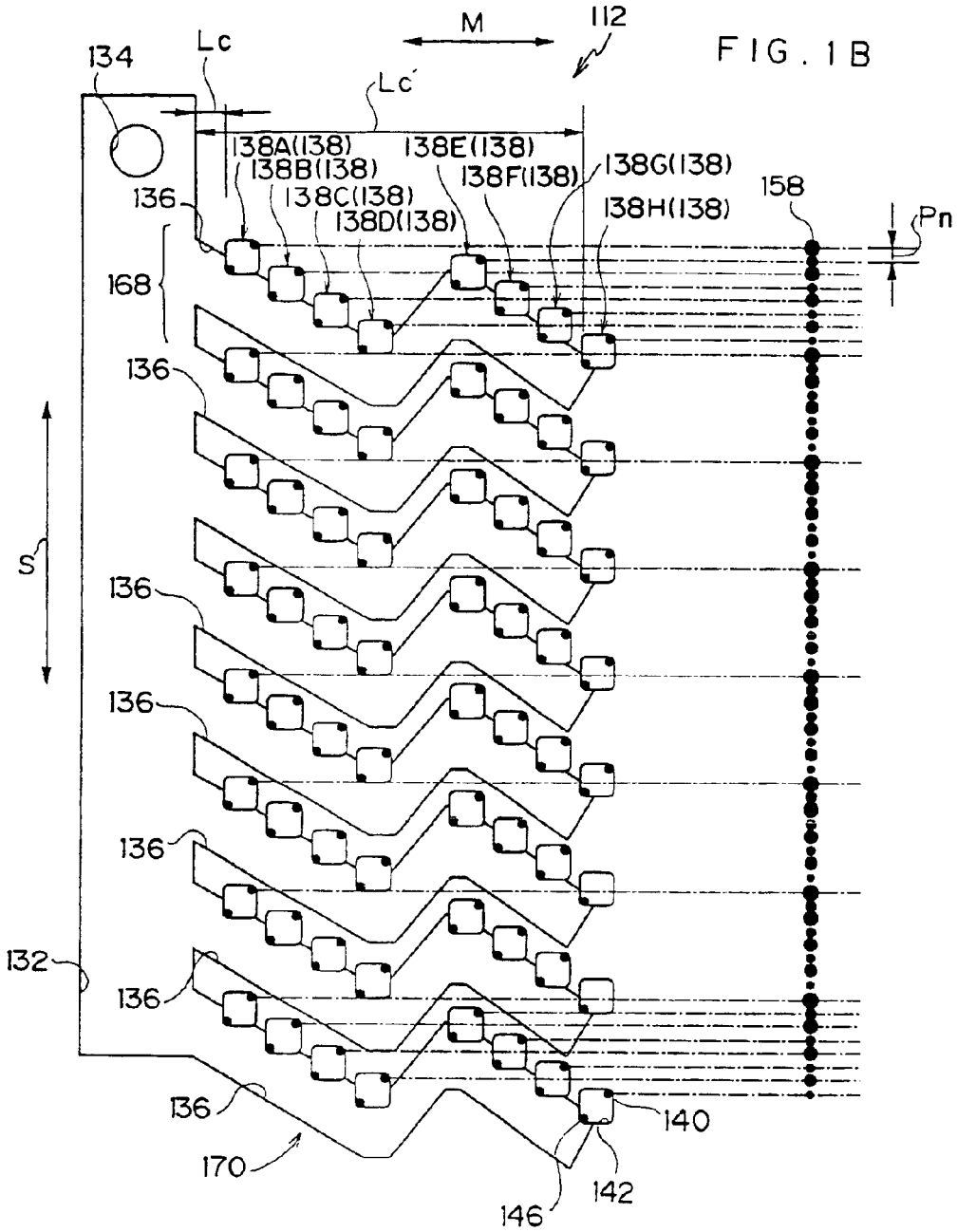
FIG. 1A is a plan view to schematically show the arrangement of ejectors of a liquid drop discharging head in accordance with the first embodiment of the invention.
FIG. 1B is an illustration to show dots that are formed and arranged in a line in a direction perpendicular to a main scanning direction by liquid drops discharged from this liquid discharging head.

The preferred embodiments of the present invention will be hereinafter described in detail with reference to drawings.

[First Embodiment]

In FIG. 1A to FIG. 3 is shown a liquid drop discharging head 112 of the first embodiment of the invention. Then, in FIG. 4 is shown a liquid drop discharging device 102 provided with this liquid drop discharging head 112. The liquid drop discharging head 112 of the present embodiment is a so-called ink jet recording head and the liquid drop discharging device 102 provided with this liquid drop discharging head 112 is an ink jet recording device. The liquid drop discharging head 102 discharges liquid drops (ink drops) of coloring inks on the recording paper P of a recording medium and is used for recording an image by dots 158 (see FIG. 1B) formed by this liquid drops.

As shown in FIG. 4, the liquid drop discharging device 102 includes a carriage 104 mounted with the liquid drop discharging head 112, a main scanning mechanism 106 that moves (mainly scans) the carriage 104 in a predetermined main scanning direction along the recording face of the recording paper P, and a sub-scanning mechanism 108 that transfers (sub-scans) the recording paper P in a predetermined sub-scanning direction intersecting (preferably, intersecting at right angle) the main scanning direction. Here, in the drawing, the main scanning direction is denoted by an arrow M and the sub-scanning direction is denoted by an arrow S, respectively.

The liquid drop discharging head 112 is mounted on the carriage 104 in such a way that its nozzle face on which nozzles 104, which will be described later, are formed is opposed to the recording paper P. While the liquid drop discharging head 112 is being moved in the main scanning direction by the main scanning mechanism 106, it discharges the liquid drops to the recording paper P, thereby recording an image in a predetermined band range BE. When the liquid drop discharging head 112 is moved once in the main scanning direction, the recording paper P is transferred in the sub-scanning direction by the sub-scanning mechanism 108 and then while the carriage 104 is being moved again in the main scanning direction, the liquid drop discharging head 112 records the image in the next band region. By repeating this operation a plurality of times, the image can be recorded on the whole surface of the recording paper P.

Figure 2:
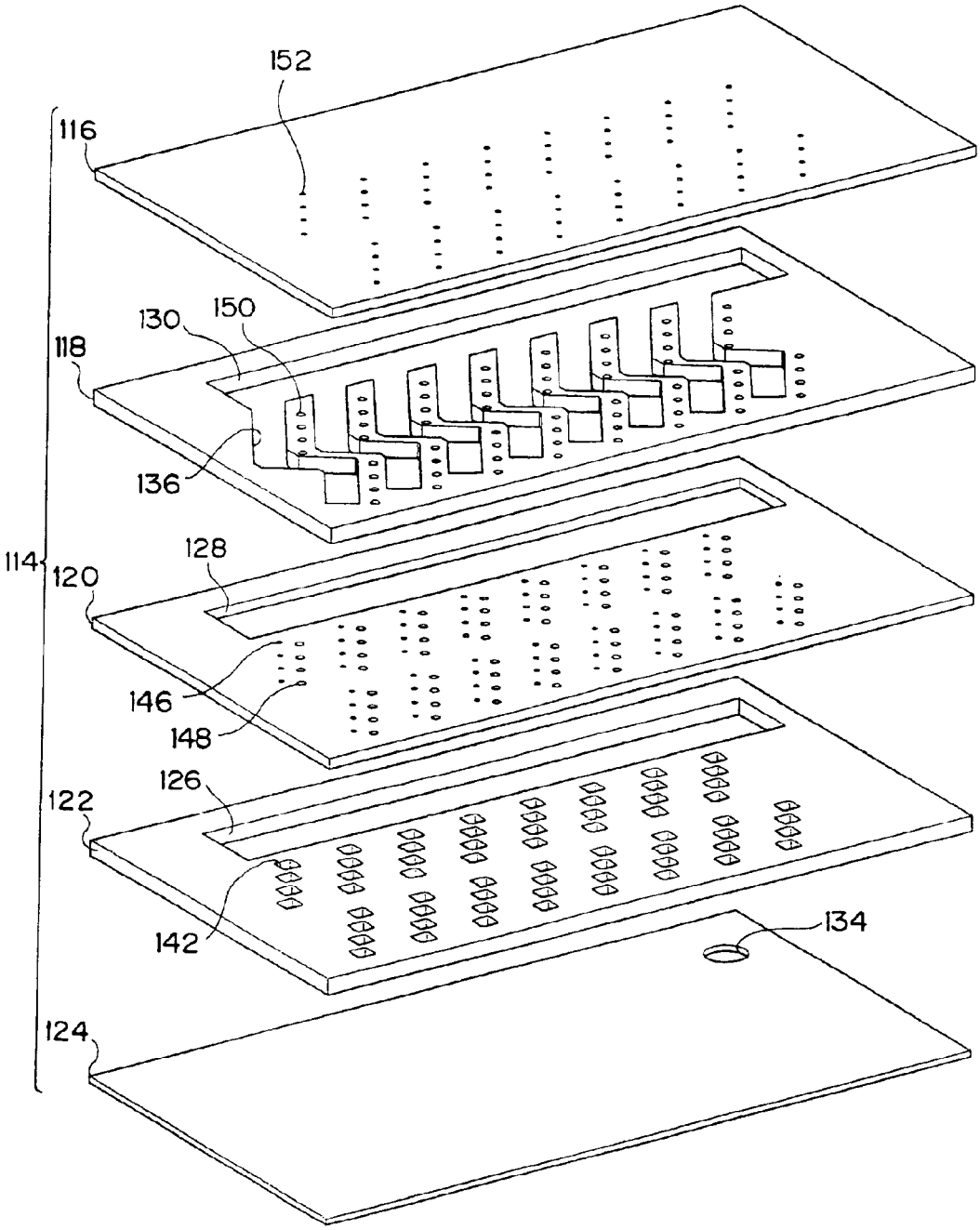
FIG. 2 is an exploded perspective view to show the construction of plates of the liquid drop discharging head in accordance with the first embodiment of the invention.

As shown in FIG. 2, the liquid drop discharging head 112 has a laminated passage plate 114. The laminated passage plate 114 is formed by aligning, laminating and bonding, with bonding means such as an adhesive, a total of five plates of a nozzle plate 116, a common passage plate 118, a supply passage plate 120, a pressure developing chamber plate 122, and a vibration plate 124. Elongated holes 126, 128, and 130 are formed in the pressure developing chamber plate 122, the supply passage plate 120 and the common passage plate 118 along the sub-scanning direction. Then, a second common passage 132 (see FIG. 1A) is formed by the elongated holes 126, 128 and 130 in a state where the common passage plate 118, the supply passage plate 120 and the pressure developing chamber plate 122 are laminated.

An ink supply port 134 is formed in the vibration plate 124 at a position corresponding to the end portion of the second common passage 132. An ink supply device (not shown) is connected to the ink supply port 134.

A plurality of common passages 136 (in the present embodiment, 32 passages per one elongated hole 130 (the second common passage 132) and among of these, only 8 passages are shown in FIGS. 1 and 2) are formed continuously from the elongated hole 130 and along the main scanning direction in the common passage plate 118. The liquid flows in the common passages 136 in a state where the supply passage plate 120, the common passage plate 118 and the nozzle plate 116 are laminated.

A plurality of pressure developing chambers 142 (in the present embodiment, 8 pressure developing chambers 142 per one common passage 136 and a total of 256 pressure developing chambers for the liquid drop discharging head 112) are formed along the common passages 136 in the pressure developing chamber plate 122. The vibration plate 124 is mounted with single plate type piezoelectric actuators 144 as pressure developing means in correspondence to the respective pressure developing chambers 142 (see FIG. 3). Further, as is clear from FIG. 1, ink supply passages 146 and ink discharge passages 148 are formed in the supply passage plate 120 in such a way that one ink supply passage 146 and one ink discharge passage 148 are formed nearly on diagonal positions of each of the pressure developing chambers 142 when the pressure developing chamber 142 is viewed on a plan view. Still further, communication passages 150 are formed in the common passage plate 118 at positions corresponding to the ink discharge passages 148 and ink discharge ports 152 are formed in the nozzle plate 116 at the positions corresponding to the ink discharge passages 148. Each nozzle 140 is constructed of the ink discharge passage 148, the communication passage 150, and the ink discharge port 152. Still further, each ejector 138 is constructed of the pressure developing chamber 142, the nozzle 140, and the piezoelectric actuator 144.

Figure 3:
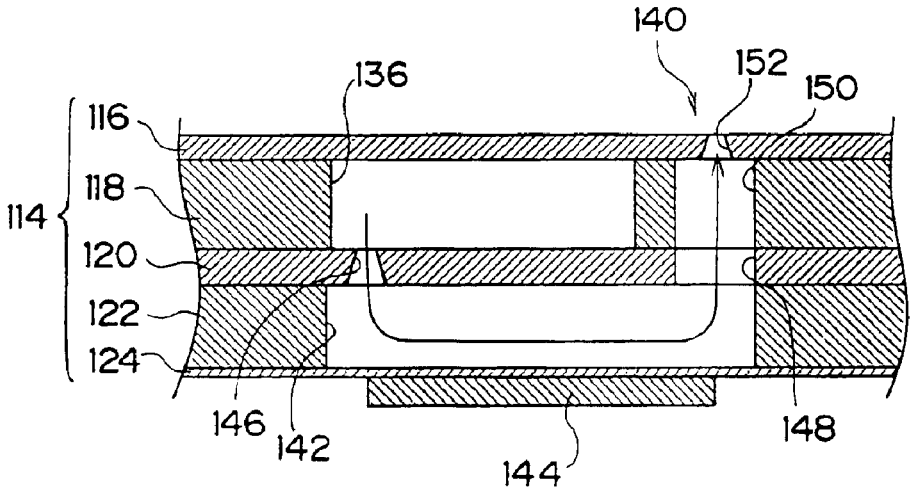
FIG. 3 is a cross-sectional view to show an ejector of the liquid drop discharging head in accordance with the first embodiment of the invention.
Figure 4:
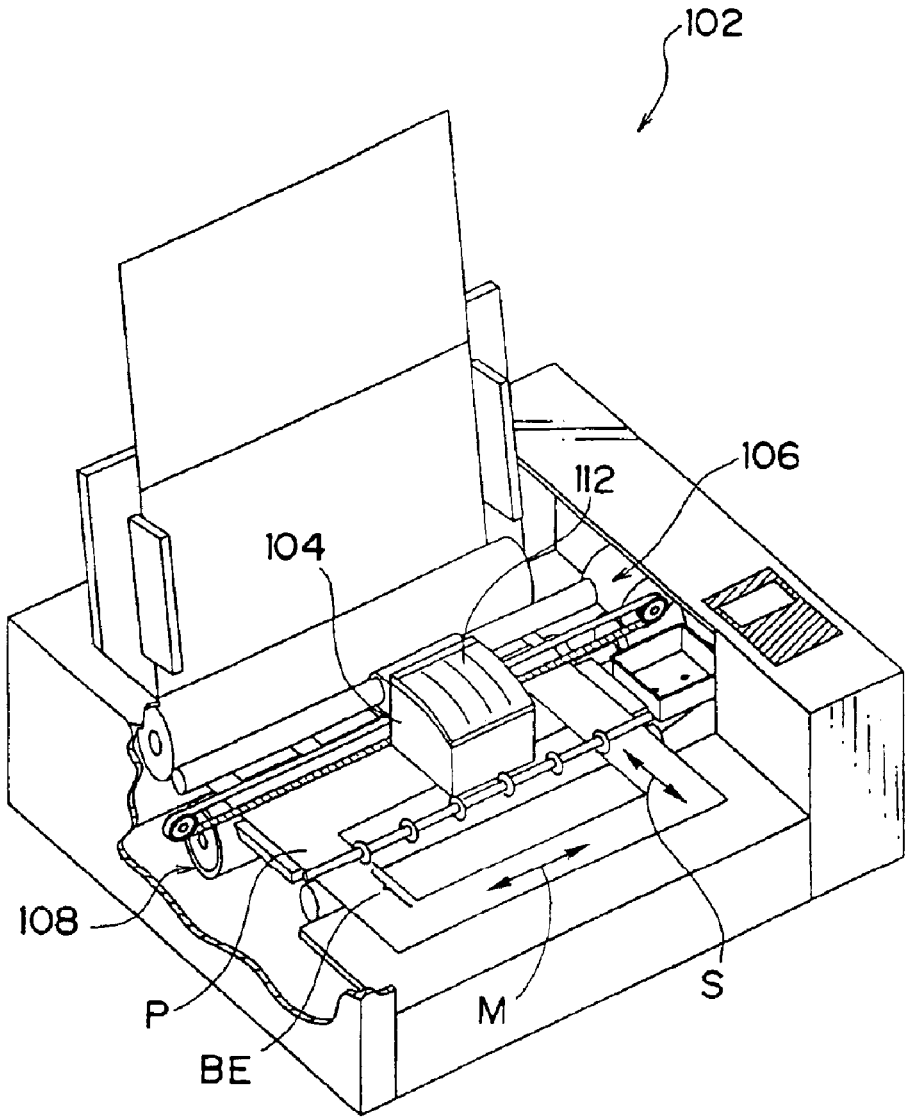
FIG. 4 is a perspective view to show a liquid drop discharging device in accordance with the first embodiment of the invention.

Therefore, as can be seen from the cross sectional view shown in FIG. 3, there is provided an ink passage that starts from the common passage 136 and leads to the pressure developing chamber 142, the ink discharge passage 148, the communication passage 150, and the ink discharge port 152. Ink supplied from an ink supply device (not shown) is supplied to the liquid drop discharging head 112 through the ink supply port 134 and is flowed into the second common passage 132 and the common passage 136 and then is filled into the pressure developing chamber 142. Here, when a driving voltage of a wave responsive to image information is applied to the piezoelectric actuator 144, the piezoelectric actuator 144 is deformed to expand or compress the pressure developing chamber 142. When this produces a change in the volume of the pressure developing chamber 142, a pressure wave is produced in the pressure developing chamber 142. The action of this pressure wave moves the ink in the nozzle 140 (ink discharge passage 148, the communication passage 150 and the ink discharged port 152) to discharge the ink to the outside from the ink discharge port 152, whereby a liquid drop is formed.

Figure 5A:
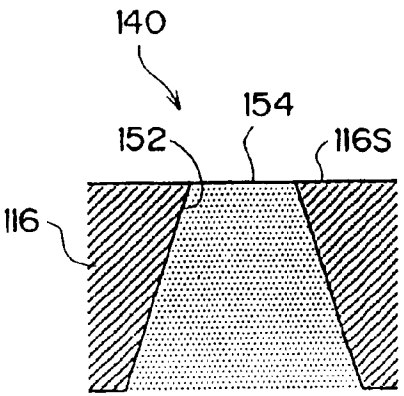
FIGS. 5A to 5F illustrate a change in a meniscus when a liquid drop is discharged from a nozzle in the liquid drop discharging head.
Figure 5B:
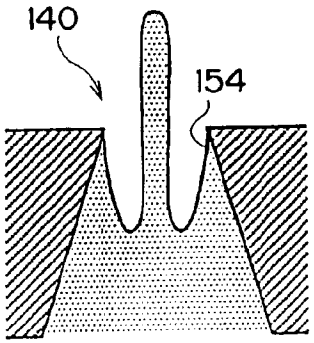
Figure 5C:
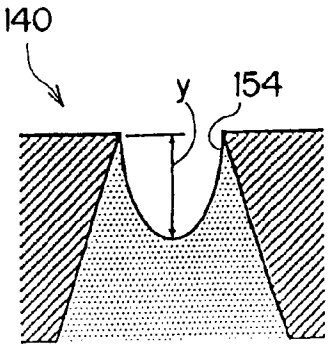
Figure 5D:
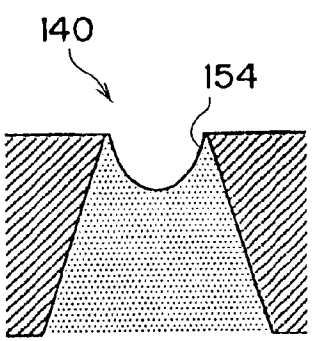
Figure 5E:
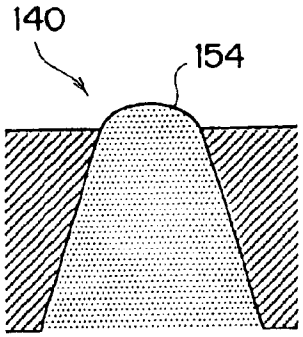
Figure 5F:
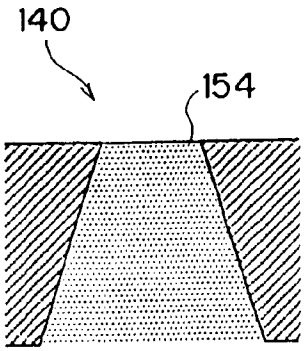
Figure 6:
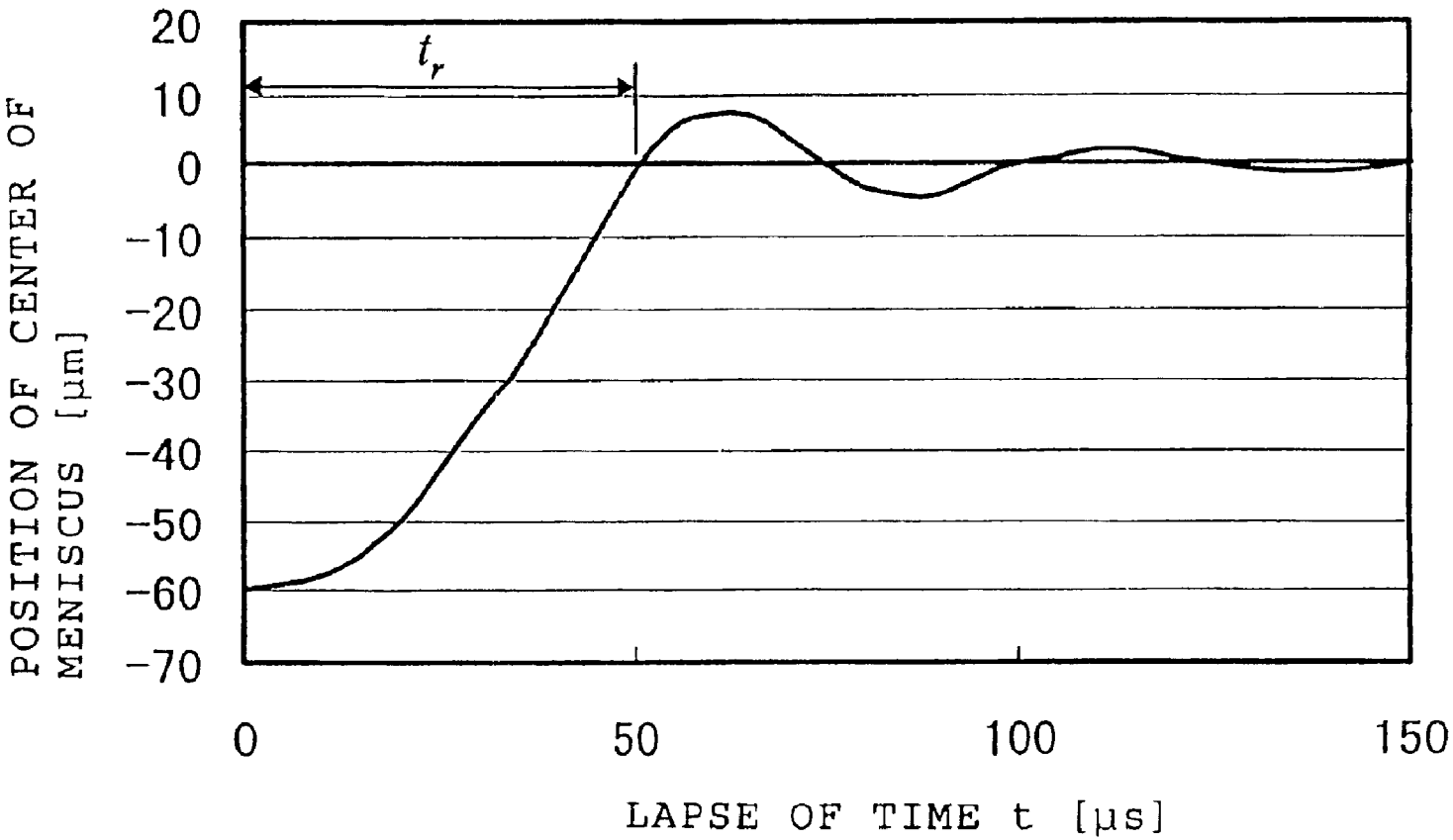
FIG. 6 is a graph to show an example of a relationship between a lapse of time and the position of center of the meniscus when the liquid drop discharging head is refilled.

The action of a meniscus 154 at the ink discharging port 152 before and after the liquid drop being discharged is schematically shown in sequence in FIGS. 5A to 5F. When the pressure developing chamber 142 is compressed, the meniscus 154 (FIG. 5A) in a nearly flat state at the beginning is moved toward the outside of the ink discharging port 152 to discharge a liquid drop 156 (FIG. 5B). When the liquid drop 156 is discharged, the amount of ink in the ink discharging port 152 is decreased to form a concave meniscus 154 (FIG. 5C). The concave meniscus 154 is gradually returned to the opening portion of the ink discharging port 152 by the action of surface tension of the ink (FIGS. 5D and 5E) to recover a state before the ink being discharged (FIG. 5F). Here, hereinafter, the returning action of the meniscus before and after the liquid drop being discharged in this manner is called "refill", and the time that lapses after the liquid drop is discharged until the meniscus 154 is first returned to the opening surface 116S of the ink discharging port 152 is called a refill time (tr). In FIG. 6 is shown the relationship between the time that lapses just after the liquid drop is discharged and a change in position of the meniscus (the position y of center of the meniscus; see FIG. 5C). The meniscus that is backed by a large amount ($y=-60\ \mu m$) just after the liquid drop is discharged ($t=0$) is vibrated in the manner shown in FIG. 6 and returned to an initial position ($y=0$).

Figure 7:
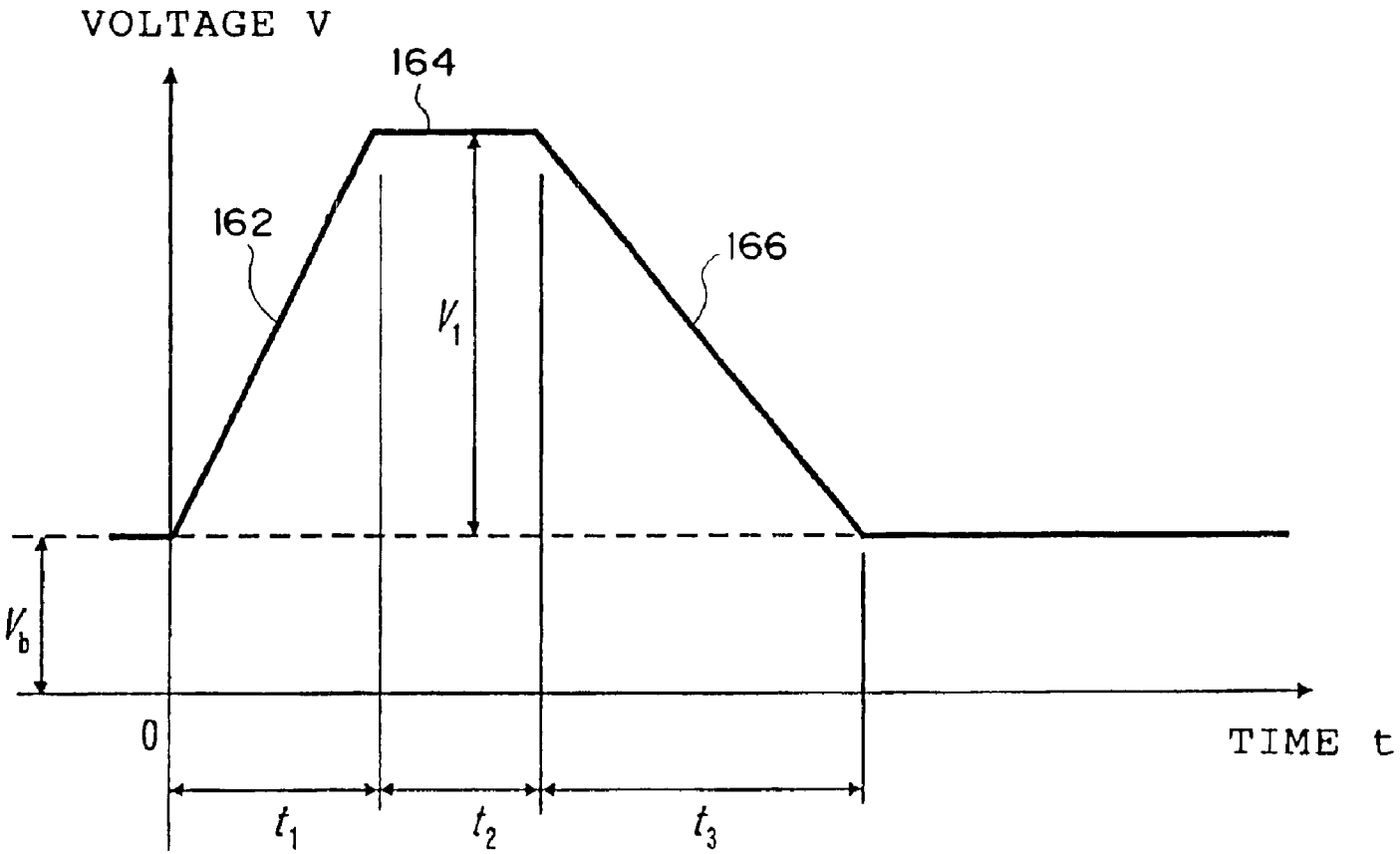
FIG. 7 is a graph to show an example of a driving voltage applied to a piezoelectric actuator of the liquid drop discharging head in accordance with the first embodiment of the invention.

In FIG. 7 is shown one example of the wave of a driving voltage applied to the piezoelectric actuator 144. The wave of this driving voltage is constructed of a first voltage changing process 162 (time $t_1$ required) to change the voltage in a direction that compresses the pressure developing chamber 142, a voltage keeping process 164 (time $t_2$ required) to keep the changed voltage (high voltage) for a predetermined time, and a second voltage changing process 166 (time $t_3$ required) to return the applied voltage to an original bias voltage (Vb).

Here, in a case where a deformation type piezoelectric actuator is used as pressure developing means, when an aspect ratio (a length-to-width ratio when viewed on a plan view) of the pressure developing chamber 142 is set nearly at 1, it is possible to maximize a discharging efficiency per unit area and hence to discharge a large liquid drop by a small pressure developing chamber 142. In other words, it is possible to minimize the area taken up by the pressure developing chamber 142 and hence to realize a matrix array head having a high array density. From this viewpoint, the above-mentioned aspect ratio is preferably set at from 0.50 to 2.00, more preferably, from 0.80 to 1.25.

The array of the ejectors 138 in the present embodiment is schematically shown in FIG. 1A. The ejectors 138 that are two-dimensionally arrayed are connected to each other by the common passages 136 arranged along the main scanning direction and further connected to each other by the second common passage 132 arranged along a direction nearly perpendicular to the main scanning direction. Therefore, an ejector unit 168 of the invention is constructed of a plurality of ejectors 138 (8 ejectors in the present embodiment) connected by one common passage 136. Further, a group of ejectors 170 of the invention are constructed of a plurality of ejector units 168 (32 ejector units in the present embodiment) connected by one common second passage 132.

In this respect, by arranging the second common passage 132 along the sub-scanning direction and the common passages 136 along the main scanning direction, it is possible to efficiently guide the liquid from the second common passage 132 to the common passages 136. This can reduce the cross sectional area of the second common passage 132 and hence the size of the liquid discharging head 112. From this point of view, it is preferable that an angle formed by the longitudinal direction of the second common passage 132 and the sub-scanning direction is smaller than 45 degree. Similarly, it is preferable that an angle formed by the longitudinal direction of the common passage 136 and the main scanning direction is also smaller than 45 degree.

The common passages 136, as shown in FIGS. 1A and 3, are arranged in such a way as to partially overlap the pressure developing chambers 142 when viewed on the plan view. When the common passages 136 are arranged in this manner in such a way that they overlap the pressure developing chambers 142, as compared with a case where the common passages 136 and the pressure developing chambers 142 are arranged on the same plane, the common passages 136 and the pressure developing chambers 142 can be efficiently arranged in a small area when viewed on the plan view, which is advantageous for reducing the size of the liquid drop discharging head 112 (high density arrangement of the ejectors 138). In this respect, when the acoustic capacity of the common passage 136 is small, an acoustic cross talk is caused between the ejectors 138 connected to the common passage 136. In order to prevent such a trouble, in the present embodiment, the top faces of the common passages 136 are constructed of the nozzle plate 116 having low rigidity and are made to function as air dampers to increase the acoustic capacities of the common passages 136.

By the way, the volume of the liquid drop 156 discharged from each ejector 138 generally varies according to the position of the ejector 138 with respect to the common passage 136. In a case of the liquid drop discharging head 112 of the present embodiment, as shown in FIG. 1, the volume of the liquid drop (hereinafter referred to as "drop volume") tends to become largest at the ejector 138A connected to the base portion of the common passage 136 and smallest at the ejector 138H connected to the tip portion of the common passage 136. The reason why the drop volume varies according to the position of the ejector is due to the fact that differences are caused in the refill characteristics between the respective ejectors. That is, when the common passage 136 is viewed from the ejector 138A connected to the base portion of the common passage 136, the passage length of the common passage 136 i.e. an effective length (Lc) for defining the time required to supply the ink from the ink supply port 134 to the ejector 138 and to complete a refill is very small. Thus, the refill characteristic of the ejector 138A is hardly affected by the inertance or the passage resistance of the common passage 136 and hence a refill speed is increased. For this reason, when the liquid drops 156 are sequentially discharged, as shown in FIG. 5E, the next liquid drop 156 is discharged in a state where the meniscus 154 becomes concave and hence the drop volume of the discharged liquid drop 156 is increased. On the other hand, when the common passage 136 is viewed from the ejector 138H connected to the tip portion of the common passage 136, the effective length (Lc') of the common passage 136 becomes very large. Thus, the refill characteristic of the ejector 138H is significantly affected by the inertance and the passage resistance of the common passage 136 and hence the refill speed is decreased. Therefore, when the liquid drops 156 are sequentially discharged, as shown in FIG. 5D, the next liquid drop is discharged before the meniscus 154 is completely returned and hence the drop volume of the discharged liquid drop is decreased.

Therefore, as for the respective ejectors 138 connected to one common passage 136, when the dot 158 of the liquid drop 156 discharged from the ejector 138A at the base portion of the common passage 136 and the dots 158 of the liquid drops 156 discharged from the ejectors 138B, 138C, 138D, 138E, 138F, 138G, and 138H which are arranged in sequence nearer to the tip of the common passage 136 are arranged at predetermined pitches Pn in the sub-scanning direction (in the direction perpendicular to the main scanning direction), a pattern is produced in which a dot diameter varies cyclically in the sub-scanning direction.

On the other hand, in the liquid drop discharging head 112 of the present embodiment, as shown in FIG. 1A, the common passage 136 is bent at a center portion in the direction of length and the ejectors 138 are arranged in such a way that the dots 158 on the recording medium are arranged in the order of ejectors 138A, 138E, 138B, 138F, 138C, 138G, 138D, and 138H. For this reason, on the recording medium, the dots 158 (each having a relatively large dot diameter) formed by the ejectors 138 connected to nearer to the tip portion of the common passage 136 and the dots 158 (each having a relatively small dot diameter) formed by the ejectors 138 connected to nearer to the base portion of the common passage 136 are mixedly arranged in the sub-scanning direction and at predetermined pitches Pn. As a result, the space frequency of variations in a print density in the sub-scanning direction is increased and hence human eyes become hard to sense the variations in the print density, which results in ensuring uniformity in recorded results.

In particular, in the present embodiment, when a plurality of dots 158 formed by one ejector unit 168 are viewed along the sub-scanning direction (direction perpendicular to the main scanning direction), the respective ejectors 138 are arranged in such a way that the dots having relatively large dot diameters and the dots having relatively small dot diameters are alternately arranged. As a result, this makes the human eyes further become hard to sense the variations in the print density.

In this manner, in the liquid drop discharging head 112 of the present embodiment, the space frequency of variations in the print density in the direction perpendicular to the main scanning direction (sub-scanning direction) can be set very high. Thus, even if big differences are caused in the discharging characteristics between the ejectors 138, depending on the arrangement of the ejectors 138 with respect to the common passage 136, it is possible to produce recorded results of high uniformity.

In addition, it is not required to change the discharging characteristic of the liquid drop 156 according to a change in the shape of the ejector 138, the common passage 136, or the like. Thus, even in a case where the ejectors 138 are arranged at high density, it is possible to reduce variations in the print density in the sub-scanning direction by the same action. Therefore, it is possible to arrange the ejectors 138 at high density and to record an image at high speeds.

Incidentally, in the above description, only the effective length of the common passage 136 is taken into account as "the passage length of fluid passage" in accordance with the invention but the length of the second common passage 132 is not taken into account. This is because, as can be seen from FIG. 1, the second common passage 132 has a large opening cross-sectional area as compared with the common passage 136 and hence the refill characteristics of the respective ejectors 138 do not depend so much on the structure of the second common passage 132. However, in a case where the refill characteristics of the respective ejectors 138 significantly depends on the structure of the second common passage 132, it is preferable to determine that "the passage length of the fluid passage" in accordance with the invention includes the second common passage 132.

As is understood from the above description, in the invention, it is noticed that there is a certain correlation (a positive correlation, a negative correlation, or a certain correlation determined by the structure of the fluid passage) between the passage length (effective length) of the fluid passage and the drop volume of the liquid drop 156, that is, the diameter of the dot 158 in each ejector 138. Then, between the dots formed by the two ejectors 138 whose passage lengths (effective lengths) of fluid passages are adjacent to each other is located the dot 158 formed by the ejector 138 having the passage length (effective length) of the other fluid passage (for example, in the example shown in FIG. 1, between the dots 158 formed by the ejector 138A and the ejector 138B is located the dot 158 formed by the ejector 138E). Then, by arranging the ejectors 138 in the manner satisfying this condition, when the dots 158 of the liquid drops 156 discharged from the respective ejectors 138 are viewed from the direction perpendicular to the main scanning direction, between two dots whose dot diameters are adjacent to each other is located a dot of another dot diameter, that is, large and small dots are mixedly arranged.

Here, "the passage length of the fluid passage" means the substantial length of the fluid passage when the fluid flows from the connection portion to the ejector. Thus, "the passage lengths of the fluid passages are adjacent to each other" means that when the passage lengths of the fluid passages corresponding to the respective ejectors constructing the ejector unit are arranged in the decreasing (or increasing) order, the passage lengths are adjacent to each other. Generally, in many cases, there is a positive (or negative) correlation between the passage length of the fluid passage and the drop volume (dot diameter) of the liquid drop discharged from the ejector. Moreover, even in a case where there is not such a positive (or negative) correlation, it is thought that there is a certain correlation determined by the structure of the fluid passage. For this reason, in a case where the ejectors are arranged in the manner described above, when the dots of the liquid drops discharged from the respective ejectors are viewed from the direction perpendicular to the main scanning direction, between two dots whose dot diameters are adjacent to each other is located a dot of another dot diameter. Thus, in at least these three dots, the dot diameter does not increase or decrease monotonously but the large and small dots are mixedly arranged in the direction perpendicular to the main scanning direction.

Here, "the dot diameters are adjacent to each other" means that when the dot diameters of the liquid drops discharged from the ejectors constructing the ejector unit are arranged in the decreasing (or increasing) order, the dot diameters are adjacent to each other. Thus, when the dots are viewed from the direction perpendicular to the main scanning direction, between two dots whose dot diameters are adjacent to each other is located a dot of another dot diameter and hence in at least these three dots, the dot diameter does not increase or decrease monotonously but the large and small dots are mixedly arranged in the direction perpendicular to the scanning direction. In other words, in the direction perpendicular to the scanning direction, the cyclic pattern of dot diameter is positively disturbed. Then, the liquid drop discharging head is moved relatively in the main scanning direction in a state where the dots of different dot diameters are mixedly arranged, whereby an image is recorded on the recording medium. Therefore, in the recorded image, variations in the print density are reduced in the direction perpendicular to the main scanning direction.

In the invention, the specific construction of the arrangement of the ejectors 138 is not necessarily limited to the construction shown in FIG. 1A. As is evident from the above description, generally, in one ejector unit 168, the passage length (effective length) of the fluid passage is shortest for the ejector 138 arranged at the base portion of the common passage 136 (ejector 138A in FIG. 1A) and becomes gradually longer nearer to the tip portion of the common passage 136. Thus, if in one ejector unit 168, for example, the dot 158 formed by the ejector 138 connected to the tip portion of the common passage 136 and the dot 158 formed by the ejector 138 connected to the base portion of the common passage 136 are mixedly arranged on the recording paper when viewed from the direction perpendicular to the main scanning direction, even if another arrangement of the ejectors is employed, it is possible to produce the same effect.

Figures 8A, 8B:
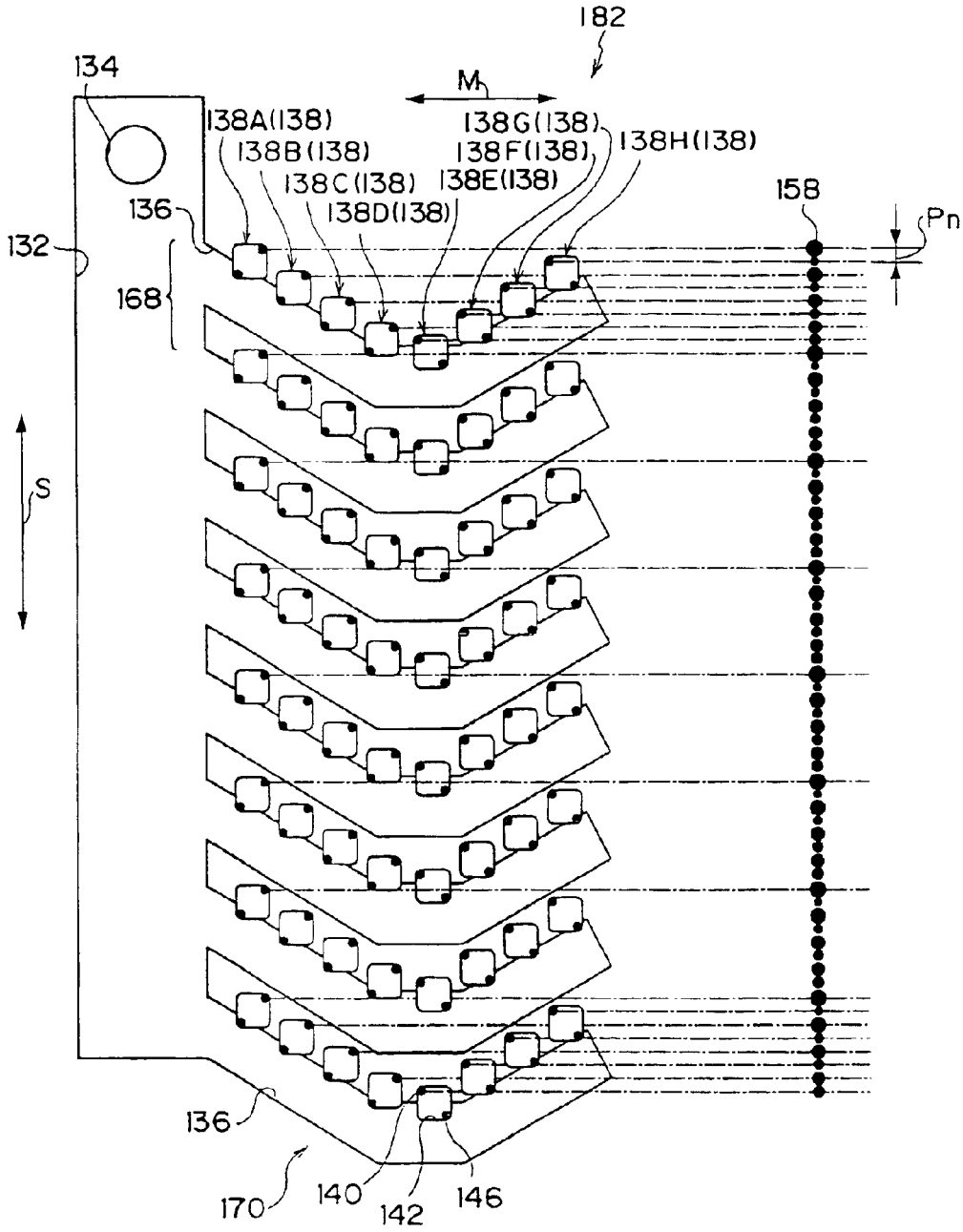
FIG. 8A is a plan view to schematically show another example of the arrangement of ejectors of the liquid drop discharging head in accordance with the first embodiment of the invention.
FIG. 8B is an illustration to show dots that are formed and arranged in a line in the direction perpendicular to the main scanning direction by liquid drops discharged from this liquid discharging head.

In FIG. 8 is shown a liquid drop discharging head 182 that satisfies such a condition and is different from the one shown in FIG. 1. In this liquid drop discharging head 182, the common passage 136 is bent nearly at a middle portion to form a shape of a flat letter V when viewed on the plan view and dots 158 on the recording medium are arranged in the order of ejectors 138A, 138H, 138B, 138G, 138C, 138F, 138D, and 138E. Even in one ejector unit 168 having this construction, the dots having relatively large dot diameters and the dots having relatively small dot diameters are mixedly arranged in the sub-scanning direction to increase the space frequency of variations in the print density in the sub-scanning direction, which results in making the human eyes become hard to sense the variations in the print density and hence ensuring high uniformity in the recorded result.

[Second Embodiment]

In FIG. 9 is schematically shown the arrangement of the ejectors 138, common passages 236, and second common passages 232 in a liquid drop discharging head 212 of the second embodiment of the invention. In the liquid drop discharging head 212 of the second embodiment, the construction of five plates and the basic structures of the respective ejectors are the same as those in the first embodiment, so that they are denoted by the same reference symbols and their detailed descriptions will be omitted. Further, a liquid discharging device employing the liquid drop discharging head 212 of the second embodiment also has the same construction as the liquid drop discharging device 102 in the first embodiment, so that its description will be omitted.

The liquid drop discharging head 212 of the second embodiment is different from the liquid drop discharging head 112 of the first embodiment in that the second common passages 232 are arranged on both sides of a group of ejectors 170 and that each of the common passages 236 is divided at the center in the direction of length.

That is, in the liquid drop discharging head 212 of the second embodiment, the respective ejectors 138 are connected to each other by the common passages 236 arranged along the main scanning direction and the second common passages 232 arranged along the direction nearly perpendicular to the main scanning direction (sub-scanning direction). The second common passages 232 arranged on both sides of the group of ejectors 170 are connected to the liquid supply device (not shown) through the ink supply ports 134 made in positions corresponding to end portions, and the respective common passages 236 and ejectors 138 are supplied with the liquid through the second common passages 236. Thirty two common passages 236 (only eight common passages are shown in the drawing) are connected to each of the second common passages 232 and four ejectors 138 are connected to each of the common passages 236. Then, in the liquid drop discharging head 212 of the second embodiment, a total of eight ejectors arranged along two divided common passages 236 construct an ejector unit 168 and a total of 256 ejectors are provided.

Figures 9A, 9B:
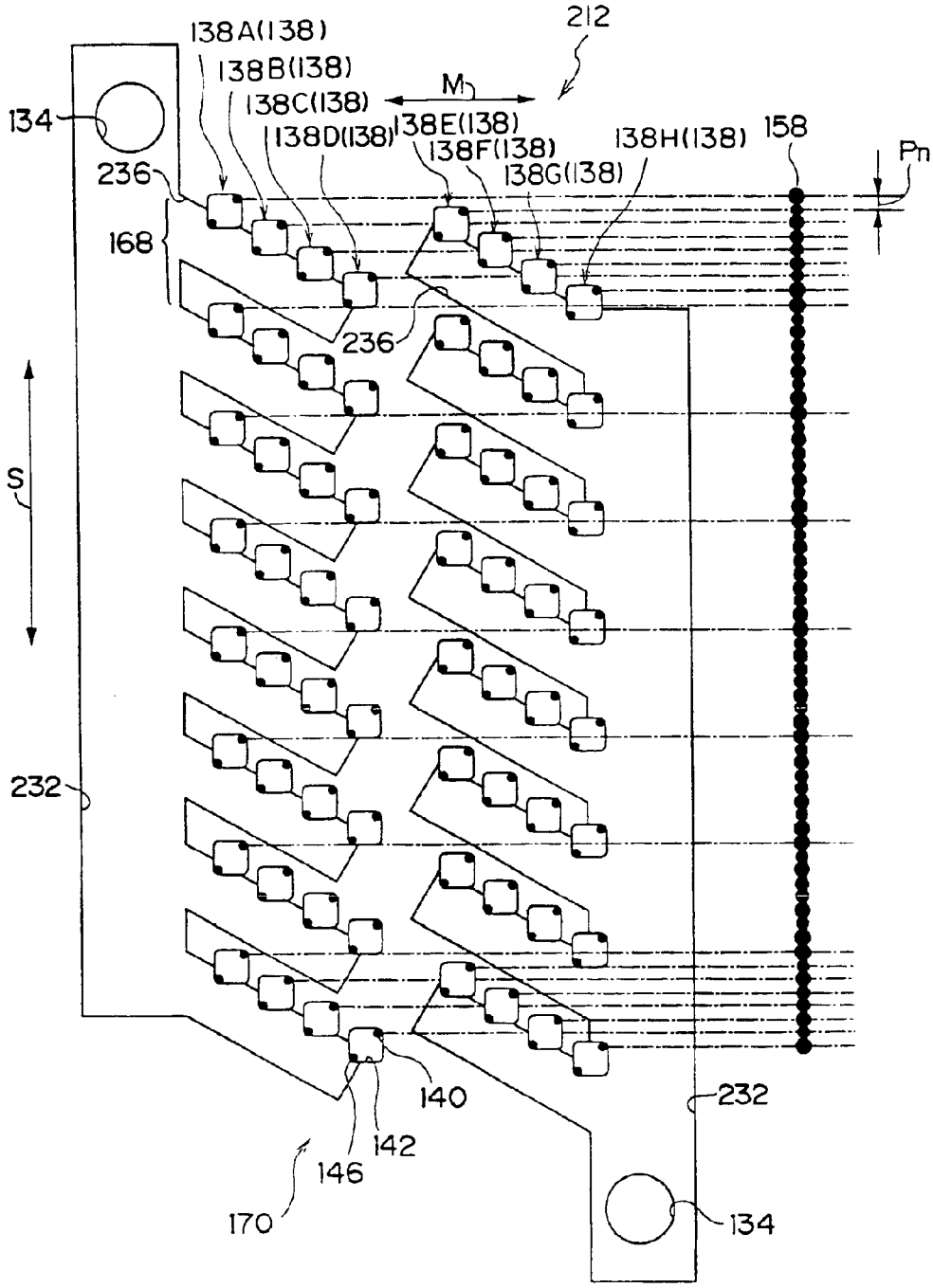
FIG. 9A is a plan view to schematically show the arrangement of ejectors of a liquid drop discharging head in accordance with the second embodiment of the invention.
FIG. 9B is an illustration to show dots that are formed and arranged in a line in the direction perpendicular to the main scanning direction by liquid drops discharged from this liquid discharging head.

The respective ejectors 138, as shown in FIG. 9A, are arranged along the respective divided common passages 236, and the ejector unit 168 is constructed on these ejectors 138A to 138H. Then, the respective ejectors 138A, 138H are arranged in such a way that in a case where the liquid drops are discharged while the liquid discharging head 212 is being moved in the main scanning direction, the dots 158 on the recording medium are arranged in the order of the ejectors 138A, 138E, 138B, 138F, 138C, 138G, 138D, and 138H. Thus, the dots 158 formed by the ejectors 138D, 138E connected to the portions nearer to the tip of the common passage 236 and the dots 158 formed by the ejectors 138A, 138H connected to the portions nearer to the base of the common passage 236 are mixedly arranged in the direction perpendicular to the main scanning direction (in the sub-scanning direction). As a result, this increases the space frequency of variations in the print density in the sub-scanning direction to make the human eyes become hard to sense variations in the print density, thereby being capable of ensuring high uniformity in the recorded result.

Further, in the second embodiment, by employing such arrangement of the common passages 236, the common passage 236 is divided into two parts along the main scanning direction in one ejector unit 168, so that the total length of the common passages 236 can be set shorter as compared with the first embodiment (can be reduced to about the half as compared with the first embodiment). For this reason, it is possible to reduce differences in the characteristics between the ejectors 138 that are caused by the positions where the ejectors 138 are mounted in the common passage 236, as compared with a construction in which the common passage 236 is not divided, and hence to further improve uniformity in the recorded result.

Here, while the common passage 236 is divided at the center in the present embodiment, if no problem is raised in a capability of discharging bubbles, or the like, by employing a structure in which the common passages 236 are connected at the center (the shape of the common passage 236 is nearly equal to the shape of the common passage 136 in the first embodiment) and in which both ends of the common passage 236 are connected to the second common passage 232, it is also possible to produce the same effect.

[Third Embodiment]

In FIG. 10 is schematically shown the arrangement of the ejectors 138, common passages 336, and a second common passage 332 in a liquid drop discharging head 312 of the third embodiment of the invention. Also in the liquid drop discharging head 312 of the third embodiment, the construction of five plates and the basic structures of the respective ejectors are the same as those in the first embodiment, so that they are denoted by the same reference symbols and their detailed descriptions will be omitted. Further, a liquid discharging device employing the liquid drop discharging head 312 of the third embodiment also has the same construction as the liquid drop discharging device 102 of the first embodiment, so that its description will be omitted.

In the liquid drop discharging head 312 of the third embodiment, the second common passage 332 is arranged nearly at the center of the group of ejectors 170 and is divided into two parts at the center in the direction of length. Further, the liquid drop discharging head 312 of the third embodiment is different from the one of the first embodiment in that the common passages 336 are connected to both sides of the second common passages 332, respectively.

That is, in the liquid drop discharging head 312 of the third embodiment, the respective ejectors 138 are connected to each other by the common passages 336 arranged along the main scanning direction and the second common passages 332 arranged along the direction nearly perpendicular to the main scanning direction (sub-scanning direction). The second common passages 332 arranged nearly at the center of the group of ejectors 170 are connected to the liquid supply device (not shown) through the ink supply ports 134 made in positions corresponding to end portions, and the respective common passages 336 and ejectors 138 are supplied with the liquid through the second common passages 332. Thirty two common passages 236 (only 16 common passages are shown in the drawing) are connected to each of the left and right sides of the second common passages 332, and four ejectors 138 are connected to each of the common passages 336. That is, the liquid drop discharging head 312 of the present embodiment also has a total of 256 ejectors.

Figures 10A, 10B:
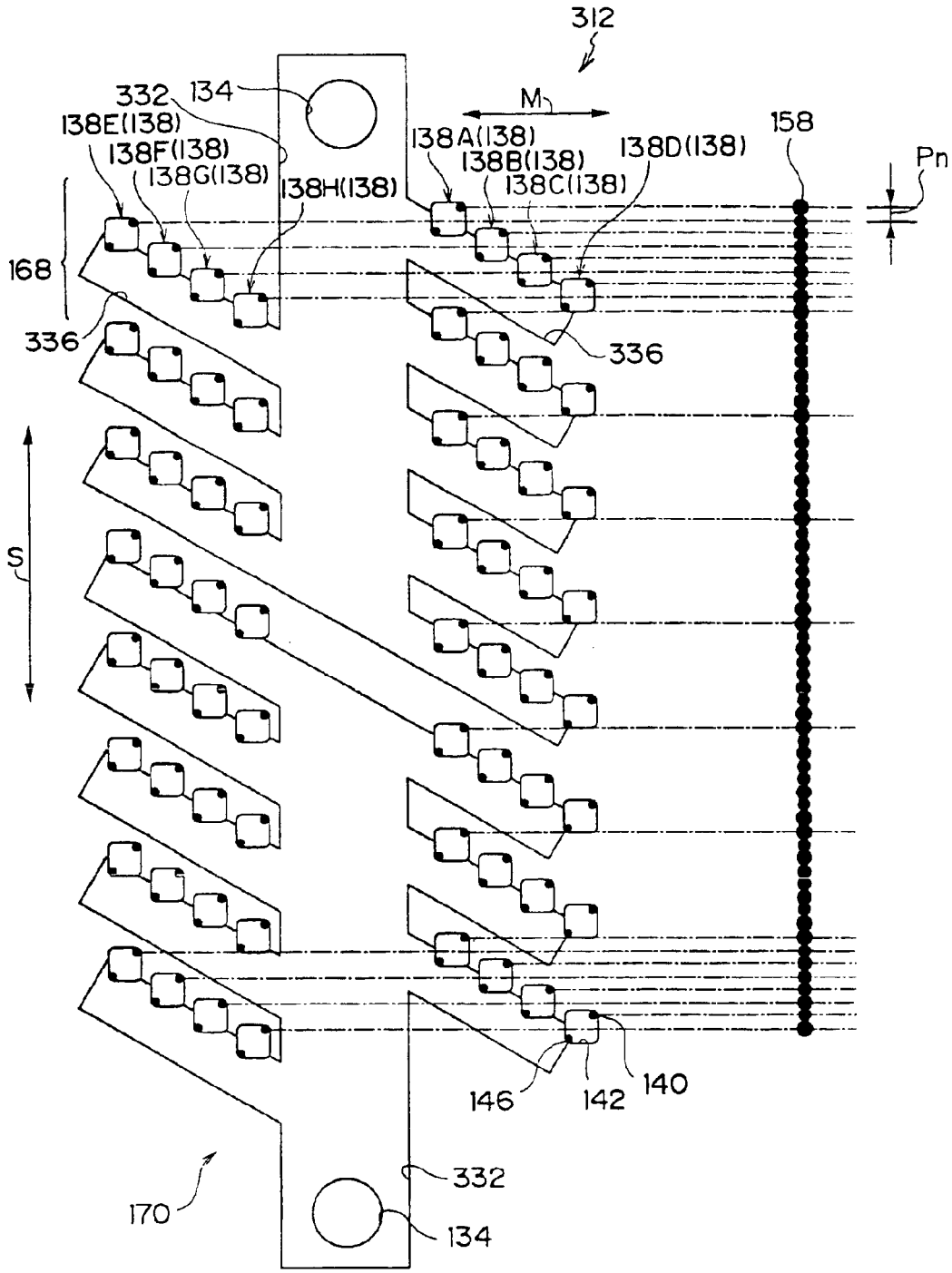
FIG. 10A is a plan view to schematically show the arrangement of ejectors of a liquid drop discharging head in accordance with the third embodiment of the invention.
FIG. 10B is an illustration to show dots that are formed and arranged in a line in the direction perpendicular to the main scanning direction by liquid drops discharged from this liquid discharging head.

The respective ejectors 138, as shown in FIG. 10A, are arranged along the respective common passages 336, and the ejector unit 168 is constructed of these ejectors 138A to 138H. Then, the respective ejectors 138A to 138H are arranged in such a way that in a case where the liquid drops are discharged while the liquid discharging head 312 is being moved in the main scanning direction, the dots 158 on the recording medium are arranged in the order of the ejectors 138A, 138E, 138B, 138F, 138C, 138G, 138D, and 138H. Thus, the dots 158 formed by the ejectors 138D, 138E connected to the portions nearer to the tip of the common passages 336 and the dots 158 formed by the ejectors 138A, 138H connected to the portions nearer to the base of the common passages 336 are mixedly arranged in the direction perpendicular to the main scanning direction (in the sub-scanning direction). As a result, this increases the space frequency of variations in the print density in the sub-scanning direction to make the human eyes become hard to sense variations in the print density, thereby being capable of ensuring high uniformity in the recorded result.

The liquid drop discharging head 312 of the third embodiment has a structure in which the common passages 336 are connected to both sides of the second common passages 332, so that as is the case with the liquid drop discharging head 212 of the second embodiment, in one ejector unit 168, each of the common passages 336 is divided into two parts along the main scanning direction. Since the total length of the common passage 336 can be set shorter as compared with the first embodiment (can be reduced to about the half as compared with the first embodiment), it is possible to reduce differences in the characteristics between the ejectors 138 that are caused by the positions where the ejectors 138 are mounted in the common passages 336 as compared with a construction in which the common passage is not divided, and hence to further improve uniformity in the recorded result. In addition, it is possible to reduce the areas taken up by the common passages 336 and hence to reduce the size of the liquid drop discharging head 312.

Further, in the liquid drop discharging head 312 of the third embodiment, the second common passage 332 can be substantially made one common passage when viewed along the main scanning direction, thereby being capable of reducing a head width in the main scanning direction. Thus, the liquid drop discharging head 312 of the third embodiment has the advantage of reducing the size of the liquid drop discharging head 312.

Still further, in the liquid drop discharging head 312 of the third embodiment, the ink supply ports 134 are made in the top end or the bottom end of each of the second common passages 332 (assuming that the second common passage is not divided into two parts, substantially, a plurality of (two)

ink supply ports 134 are made in one second common passage) and further the second passage 332 is divided into two parts at the center. By employing the passage structure described above in which the plurality of ink supply ports 134 are made and a plurality of second common passages 332 are provided, it is possible to reduce the passage resistance (effective length) of the second common passages 332 and hence to reduce the width required (or the area taken up) by the second common passages 332. Thus, the liquid drop discharging head 312 of the third embodiment has the advantage of reducing the size of the liquid drop discharging head. Here, the reason why the second common passage 332 is divided at the center in FIG. 10A is due to increasing a capability of discharging bubbles in the second common passage 332, so that if no problem is raised in the capability of discharging the bubbles, there is nothing wrong with connecting the second common passages 332. Even if the liquid drop discharging head 312 of the third embodiment has the structure in which the second common passages 332 are connected, the second common passage 332 is supplied with liquid from the plurality of (two, in the present embodiment) ink supply ports 134, so that it is possible to reduce the width required (or the area taken up) by the second common passage 332 and hence to reduce the size of the liquid drop discharging head. In particular, in the present embodiment, preferably, the liquid is supplied from the ink supply ports 134 made in both ends. Moreover, from the similar viewpoint, it is also recommended that three or more ink supply ports 134 be made in the second common passage 332.

Figures 11A, 11B:
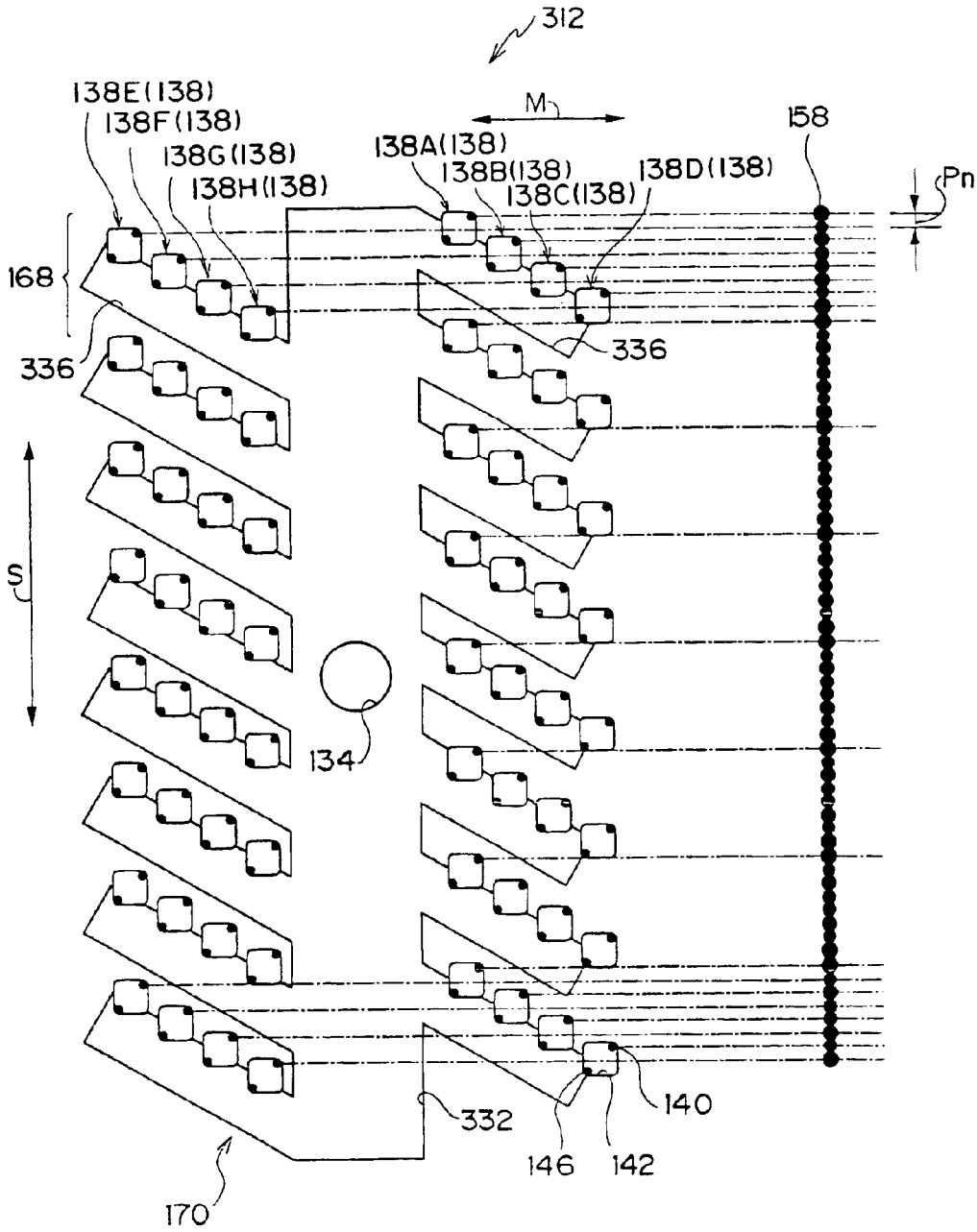
FIG. 11A is a plan view to schematically show another example of the arrangement of ejectors of the liquid drop discharging head in accordance with the third embodiment of the invention.
FIG. 11B is an illustration to show dots that are formed and arranged in a line in the direction perpendicular to the main scanning direction by liquid drops discharged from this liquid discharging head.

Incidentally, as shown in FIG. 11A, also by employing a structure in which the second common passages 332 are connected and making the ink supply port 134 near the center of the connected second common passages 332, it is possible to reduce the passage resistance (effective length) of the second common passage 332 and hence to reduce the size of the head.

Figures 12A, 12B:
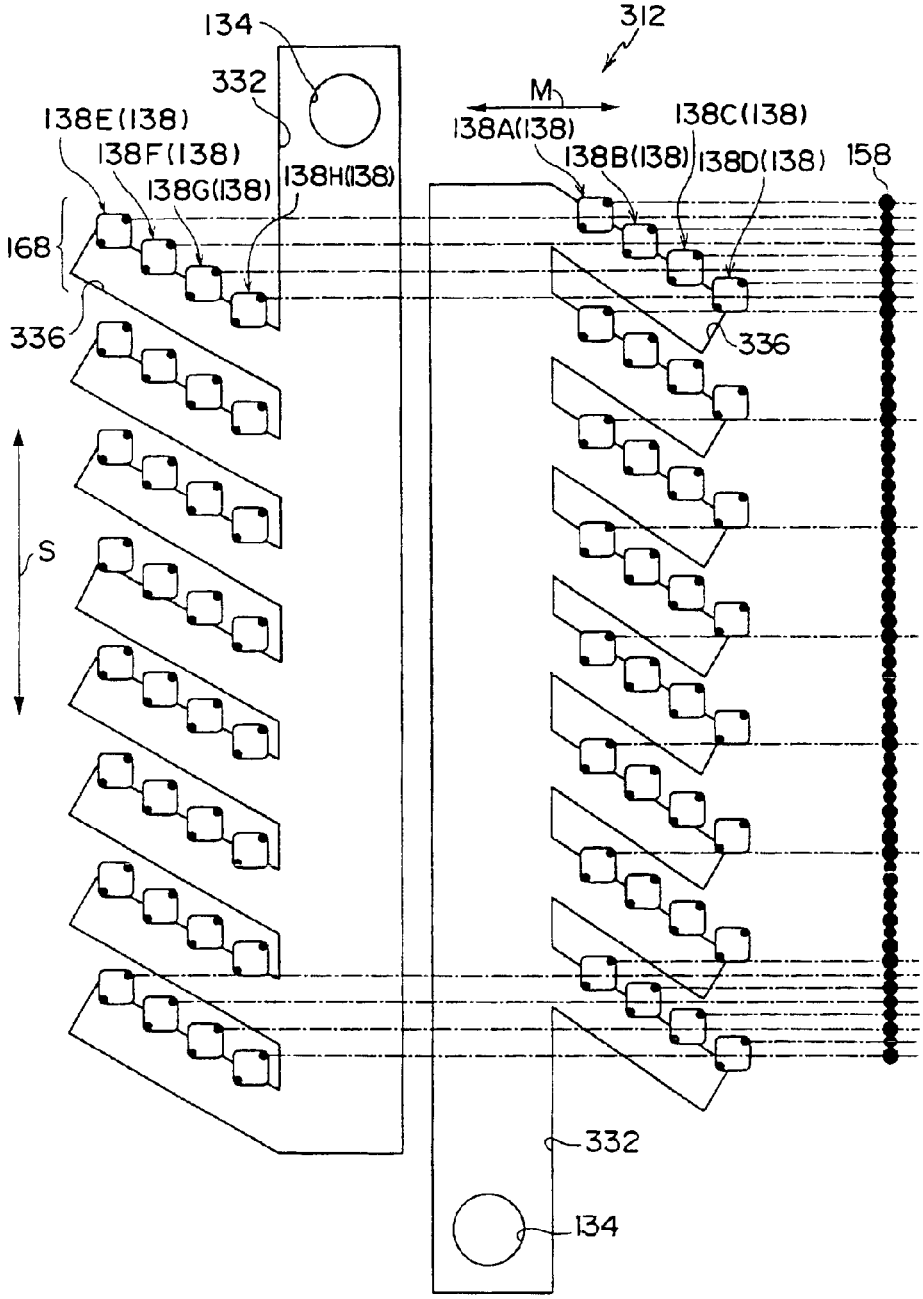
FIG. 12A is a plan view to schematically show still another example of the arrangement of ejectors of the liquid drop discharging head in accordance with the third embodiment of the invention.
FIG. 12B is an illustration to show dots that are formed and arranged in a line in the direction perpendicular to the main scanning direction by liquid drops discharged from this liquid discharging head.
Figure 13:
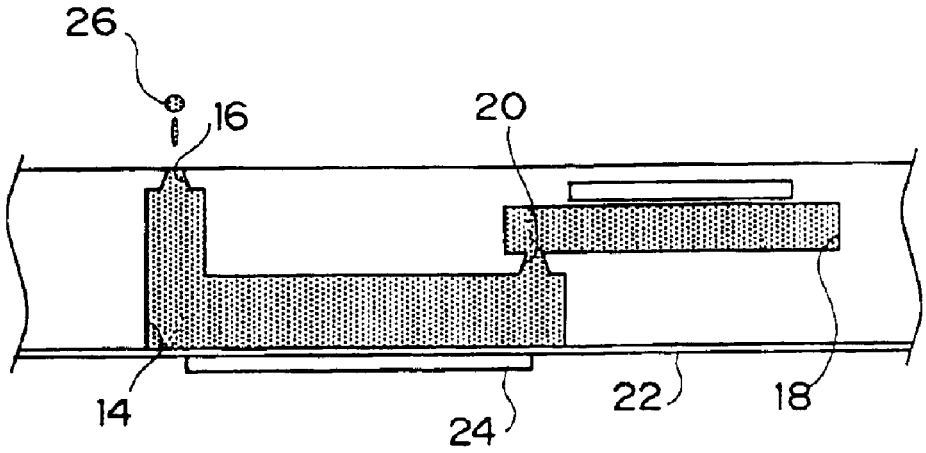
FIG. 13 PRIOR ART
FIG. 13 is a cross-sectional view to show the structure of a conventional liquid drop discharging head.
Figure 14:
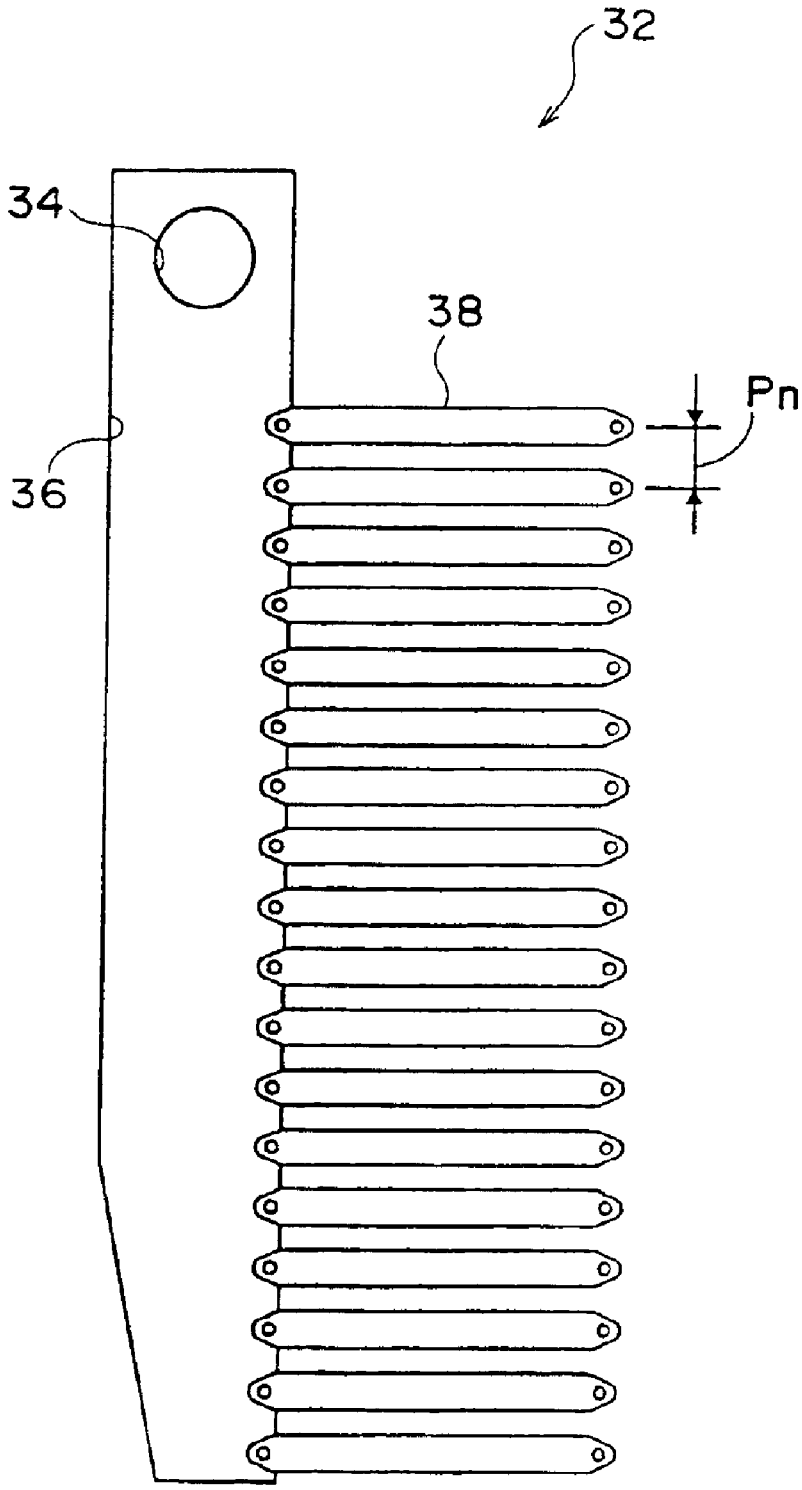
FIG. 14 PRIOR ART
FIG. 14 is a plan view to schematically show the arrangement of ejectors of conventional linear array liquid drop discharging head.

Moreover, in the liquid drop discharging head 312 of the third embodiment, the second common passage 332 is arranged in the center of the group of ejectors 170 and the common passages 336 are connected to both sides of the second common passage 332. However, it is also possible to employ other passage structures such as the passage structure shown in FIG. 12 in which two second common passages 332 each having the common passages 336 connected only to one side thereof are arranged in parallel in the center of the group of ejectors 170. However, the passage structure shown in FIG. 12 elongates the effective length of the second common passage 332 and hence increases the width required by the whole second common passage 332 and becomes disadvantageous to reducing the size of the liquid drop discharging head.

While the embodiments of the invention have been described up to this point, these embodiments show the preferred embodiments of the invention and it is not intended to limit the invention to these embodiments. That is, various modifications, improvements, corrections and simplifications can be added to the embodiments described above within the spirit of the invention.

For example, while the piezoelectric actuator has been used as pressure developing means in the respective embodiments described above, there is nothing wrong with using other pressure developing means such as an electro-mechanical conversion device utilizing an electrostatic force or a magnetic force, an electro-thermal conversion device utilizing a boiling phenomenon, and the like. Further, also as for the piezoelectric actuator, in addition to the single plate type piezoelectric actuator used in the present embodiment, other actuators such as a longitudinal vibration type laminated piezoelectric actuator and the like can be used.

Further, while the passage is formed by laminating a plurality of plates in the respective embodiments described above, the construction and materials of the plates are not limited to the embodiments described above. For example, the nozzle plate 116 has been used as the air dampers of the common passages 136, 236, 336 in the embodiments described above. However, the invention can be applied to a head having other construction of the plates such as inserting a plate specifically designed to function as the air damper. Moreover, the invention can be similarly applied to a head in which the passages are integrally molded by the use of materials such as ceramic, glass, resin, silicon and the like.

Still further, while the pressure developing chamber 142 is squarely formed in the respective embodiments described above, it is also possible to use a pressure developing chamber formed in other shapes such as a circle, a hexagon, a rectangle, or the like. Moreover, while the pressure developing chambers are formed in the same shape in head, there is nothing wrong with mixing pressure developing chambers formed in different shapes.

Still further, while the ejectors 138 are arranged in the same manner with respect to the respective common passages in the respective embodiments described above, the ejectors are not necessarily arranged in a regular manner with respect to the common passages, but the ejectors can be arranged in different manners in the respective common passages. There is nothing wrong with arranging the ejectors in different manners in the respective common passages, for example, in the first embodiment shown in FIG. 1, arranging the ejectors 138 in such a way that in the uppermost common passage 136 in FIG. 1, the dots are arranged in the order of ejectors 138A, 138E, 138B, 138F, 138C, 138G, 138D, and 138H and that in the second common passage 136, the dots are arranged in the order of ejectors 138E, 138A, 138F, 138B, 138G 138C, 138H, and 138D.

Still further, in the respective embodiments described above, when a plurality of dots 158 formed by one ejector unit 168 are viewed along the sub-scanning direction (direction perpendicular to the main scanning direction), the respective ejectors 138 are arranged in such a way that the dots having relatively large diameters and the dots having relatively small diameters are alternately arranged. However, it is not necessarily required to alternately arrange the dots having large diameters and the dots having small diameters. However, the alternate arrangement of the dots 158 having large diameters and the dots 158 having small diameters makes the human eyes become harder to sense variations in the print density in the sub-scanning direction and hence is preferable.

Still further, in the respective embodiments described above, as an example has been taken the liquid drop discharging head in which, in one liquid drop discharging head, the ejector unit 168 is constructed of the plurality of ejectors 138 and in which one group of ejectors 170 are constructed of the plurality of ejector units 168. However, one group of ejectors 170 can be constructed of only one ejector unit 168 (that is, the ejector unit 168 coincides with the one group of ejectors 170). However, in a case of employing this construction, assuming that the number of the ejectors 138 constructing one group of ejectors 170 is nearly equal to the number (eight) of the ejector units 168 in the respective embodiments, a band region is reduced on which the liquid drop discharging head can record the image by one main scanning operation, so that this construction becomes disadvantageous to recording the image at high speeds. Therefore, in a case where one group of ejectors 170 are constructed of only one ejector unit 168, it is preferable that the one group of ejectors 170 be constructed of a number of ejectors 138 that do not raise such a problem.

Still further, while the common passages and the second common passage are formed in the laminated passage plate 114 in the respective embodiments described above, the structures of the common passages and the second common passage are not necessarily limited to those in the respective embodiments described above. It is possible to employ other passage structure, for example, a structure in which the second passage is not formed in the laminated passage plate 114 but the ink supply device is directly connected to the laminated passage plate 114 to make the ink supply device itself act as the second common passage.

Still further, it is also possible to employ still another structure in which the second common passage 132 is omitted in the laminated passage plate 114 and in which the ink supply port 134 is directly connected to the respective ejectors 138 by individual passages.

Still further, the ink jet recording head that discharges coloring liquid drops (ink drops) onto the recording paper P to record characters and images and the ink jet recording device using the ink jet recording head have been taken as examples in the respective embodiments described above. However, the liquid drop discharging head and the liquid drop discharging device of the invention are not necessarily limited to those used for ink jet recording, that is, recording characters and images on the recording paper. Moreover, the recording medium is not necessarily limited to paper and the liquid to be discharged is not necessarily limited to the coloring ink, either. The liquid drop discharging head and the liquid drop discharging device of the invention can be generally applied to a liquid drop ejecting device designed for various industrial uses such as discharging coloring inks onto a macromolecular film or a glass plate to manufacture a color filter for a display, discharging fused solder onto a substrate to form bumps for mounting components, discharging an organic EL solution onto a substrate to form an EL display panel, and discharging fused solder onto a substrate to form electrical mounting bumps.

Still further, as the liquid drop discharging device has been described above the preferred embodiment in which while the liquid drop discharging head is being moved by the carriage, the liquid drops are discharged. However, the present invention can be applied to the other devices, for example, a device in which by the use of a line type liquid drop discharging head having ink discharging ports 152 arranged over the whole width of the recording medium, characters and images are recorded on the recording medium with the head fixed and only the recording paper being carried.

The invention will be further detailed in the following by experimental examples.

In the following respective experimental examples was used a liquid drop discharging device having the same structure as the liquid drop discharging heads 112, 212, 312 of the respective embodiments of the invention. In the liquid drop discharging device, matrix array heads having 260 ejectors for one of four color inks of yellow, magenta, cyan, and black were arranged side by side on a carriage 104. Then, four color dots were overlaid on the recording paper to record the image in full colors. Then, the recorded image was visually observed to evaluate the quality of the recorded image. Moreover, as a comparative example, a liquid drop discharging device provided with the matrix array head 42 shown in FIG. 15A was used and the image recorded in the same manner was visually observed.

EXPERIMENTAL EXAMPLE 1

In an experimental example 1, a liquid drop discharging device provided with the liquid drop discharging head 112 of the first embodiment was used. The liquid drop discharging head 112 was specifically constructed as follows: a polyimide film of 25 μm in thickness was used as the nozzle plate 116 and nozzles 140 each having an opening diameter of 25 μm were formed by an excimer laser; a stainless steel sheet of 75 μm in thickness was used as the supply passage plate 120 and the ink supply port 134 having an opening diameter of 26 μm was formed by a press; and a stainless steel sheet of 120 μm in thickness was used as the common passage plate 118 and the pressure developing chamber plate 122 and a passage pattern was formed by wet etching.

The pressure developing chamber 142 was formed into a square having a side of 550 μm in length and an aspect ratio of 1.

A stainless steel sheet of 10 μm in thickness was used as the vibration plate 124. Moreover, a single plate type piezoelectric ceramic of 30 μm in thickness was used as the piezoelectric actuator 144. The liquid drop discharging head 112 of the present experimental example could discharge a liquid drop of about 19 pl in liquid volume when V1 was set at 30 V (see FIG. 7).

Then, in the present experimental example, a recording resolution in the sub-scanning direction was set at 300 dpi (Pn=85 μm). Thus, the space frequency of variations in the print density became about 12 cycle/mm, which very much reduced the sensitivity of the human eyes to variations in the print density.

Ink drops were actually discharged by the use of the liquid drop discharging device provided with the liquid drop discharging head 112 of the present experimental example to record an image on the recording paper P. As a result, the liquid drop discharging head 112 of the present experimental example produced a difference of about 10% in the liquid volume between the liquid drop discharged from the ejector 138A and the liquid drop discharged from the ejector 138H and hence also produced a difference of about 10% in dot diameter on the recording medium. However, although such a difference in the dot diameter was produced, when the image was observed, it was found that because the large dots and the small dots were mixedly arranged on the recording medium, unevenness in the print density was hardly noticeable and the image was of high uniformity.

EXPERIMENTAL EXAMPLE 2

In the experimental example 2, a liquid drop discharging device provided with the liquid drop discharging head 212 of the second embodiment was used (see FIG. 9). The specific construction (material, size, and the like) of the liquid drop discharging head 212 was the same as that in the experimental example 1.

Then, a recording experiment was performed by the use of the liquid drop discharging device of the second experimental example 2. As a result, a difference in dot diameter between the dot formed by the ejector 138A connected to the base portion of the common passage 236 and the dot formed by the ejector 138D connected to the tip portion of the common passage 236 was reduced to about 4%. Moreover, since the large dots and the small dots were mixedly arranged on the recording medium, the human eyes could hardly sense variations in the print density. Thus, the image of extremely high uniformity could be recorded.

EXPERIMENTAL EXAMPLE 3

In the experimental example 3, a liquid drop discharging device provided with the liquid drop discharging head 312 of the third embodiment was used (see FIG. 10). The specific construction (material, size, and the like) of the liquid drop discharging head 312 was the same as that in the experimental example 1.

Then, a recording experiment was performed by the use of the liquid drop discharging device of the second experimental example 2. As a result, a difference in dot diameter between the dot formed by the ejector 138A connected to the base portion of the common passage 236 and the dot formed by the ejector 138D connected to the tip portion of the common passage 236 was reduced to about 4%. Moreover, since the large dots and the small dots were mixedly arranged on the recording medium, the human eyes could hardly sense variations in the print density. Thus, the image of extremely high uniformity could be recorded.

COMPARATIVE EXAMPLE

Figures 15A, 15B:
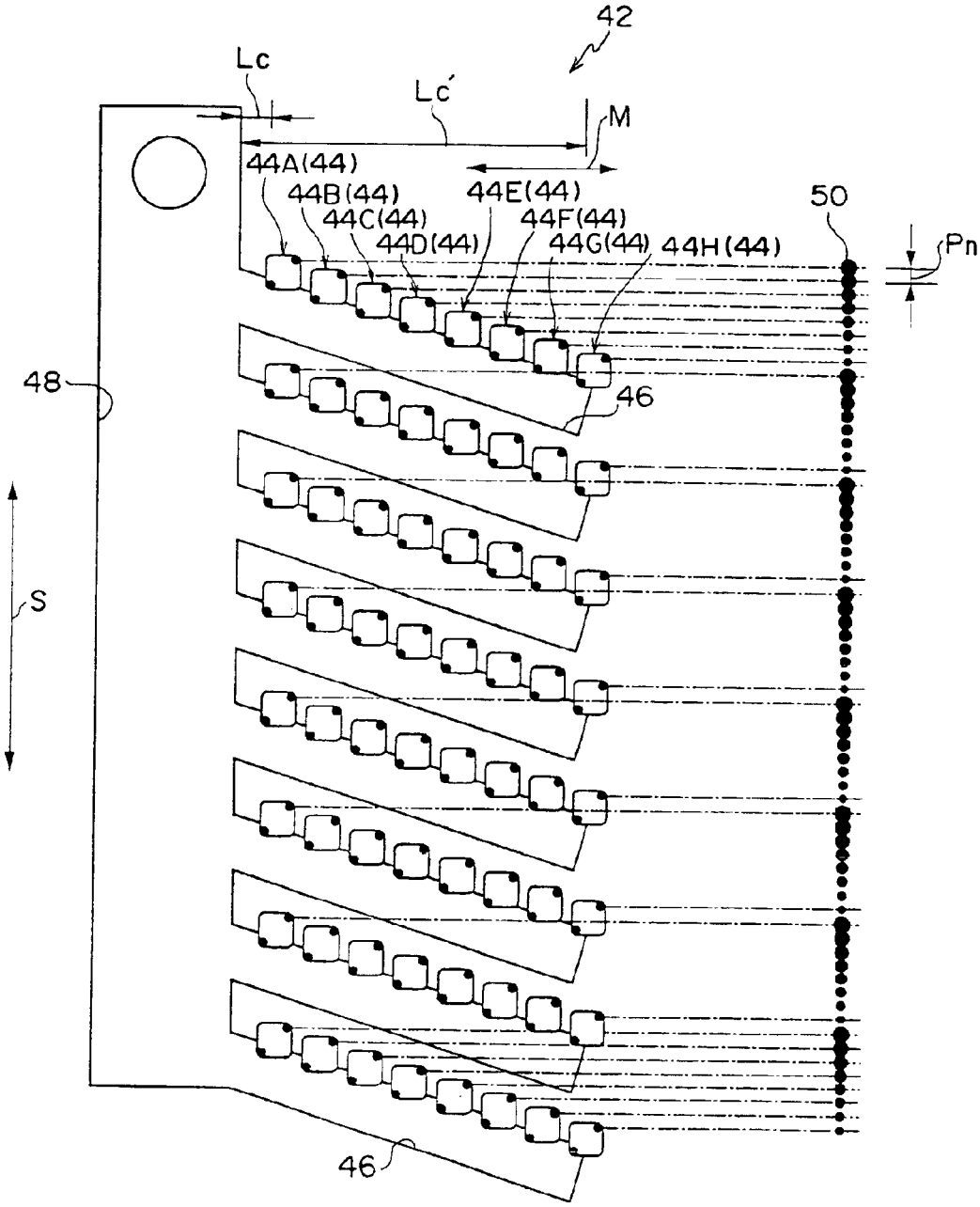
FIG. 15A PRIOR ART
FIG. 15B PRIOR ART
FIG. 15A is a plan view to schematically show the arrangement of ejectors of conventional matrix array liquid drop discharging head.
FIG. 15B is an illustration to show dots that are formed and arranged in a line in the direction perpendicular to the main scanning direction by liquid drops discharged from this liquid discharging head.
Figures 16A, 16B:
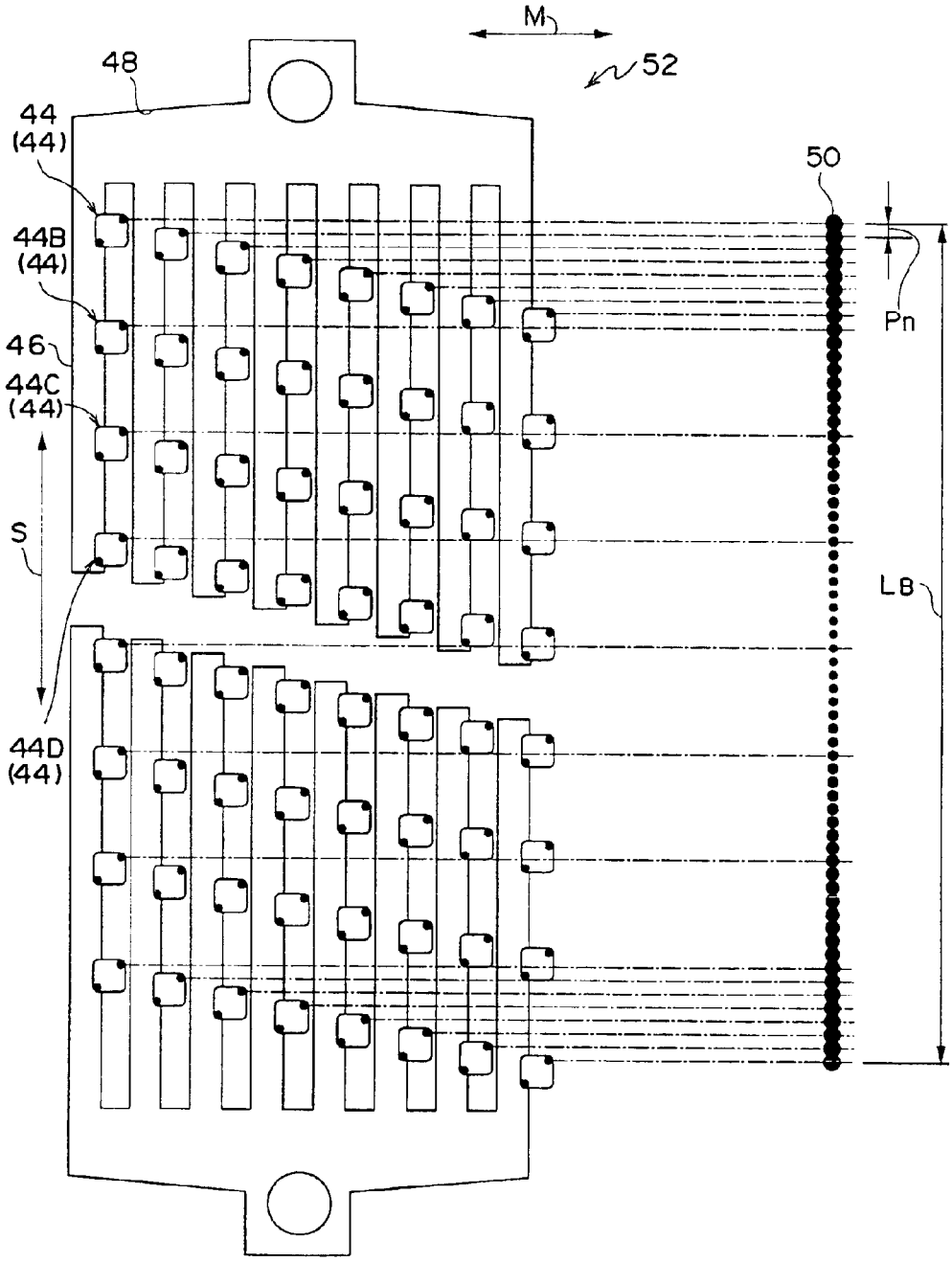
FIG. 16A PRIOR ART
FIG. 16B PRIOR ART
FIG. 16A is a plan view to schematically show another example of the arrangement of ejectors of the conventional matrix array liquid drop discharging head.
FIG. 16B is an illustration to show dots that are formed and arranged in a line in the direction perpendicular to the main scanning direction by liquid drops discharged from this liquid discharging head.
Figure 17:
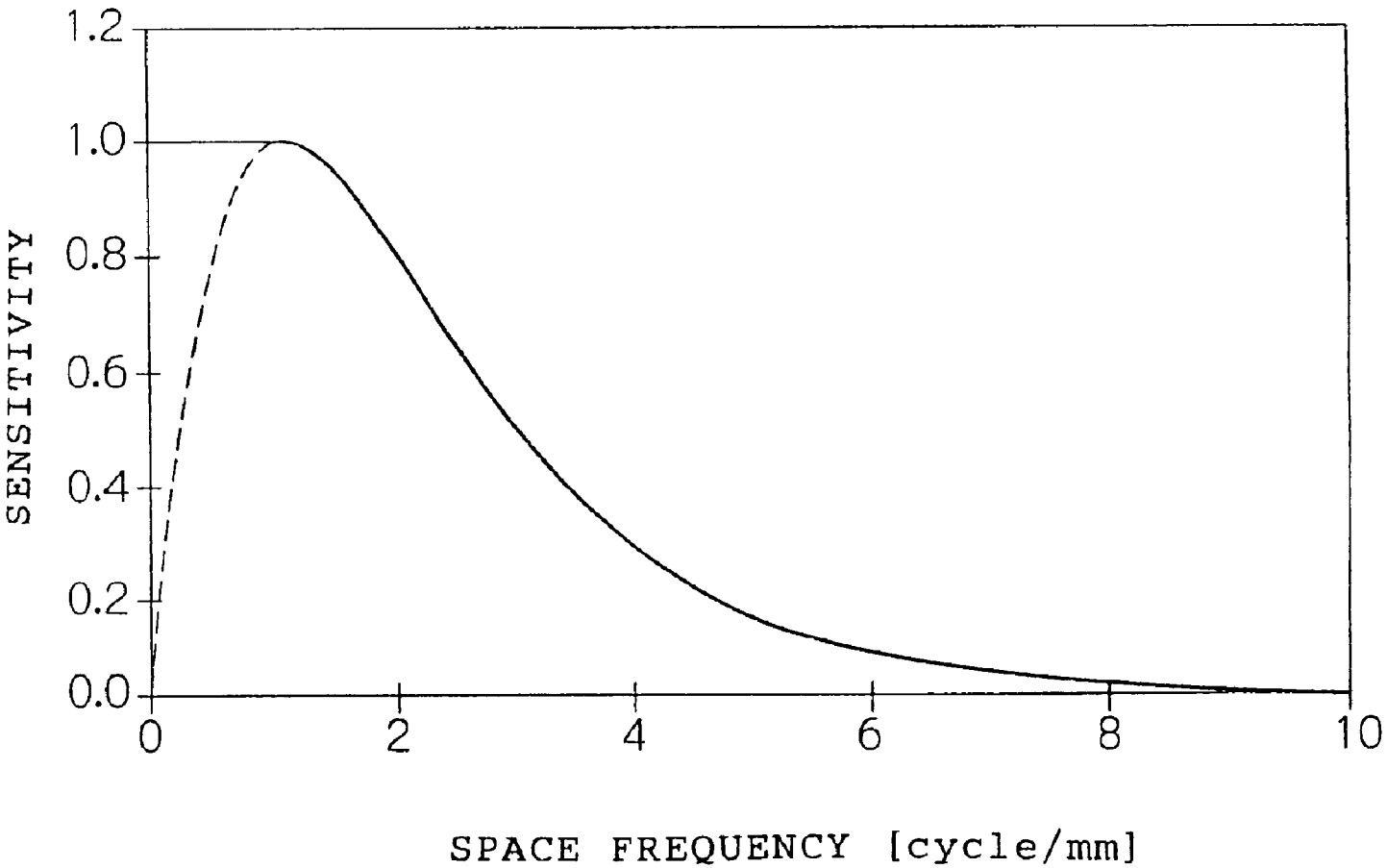
FIG. 17 is a graph to show the sensitivity of human eyes to variations in a print density with a lateral axis as a space frequency.
Figure 18:
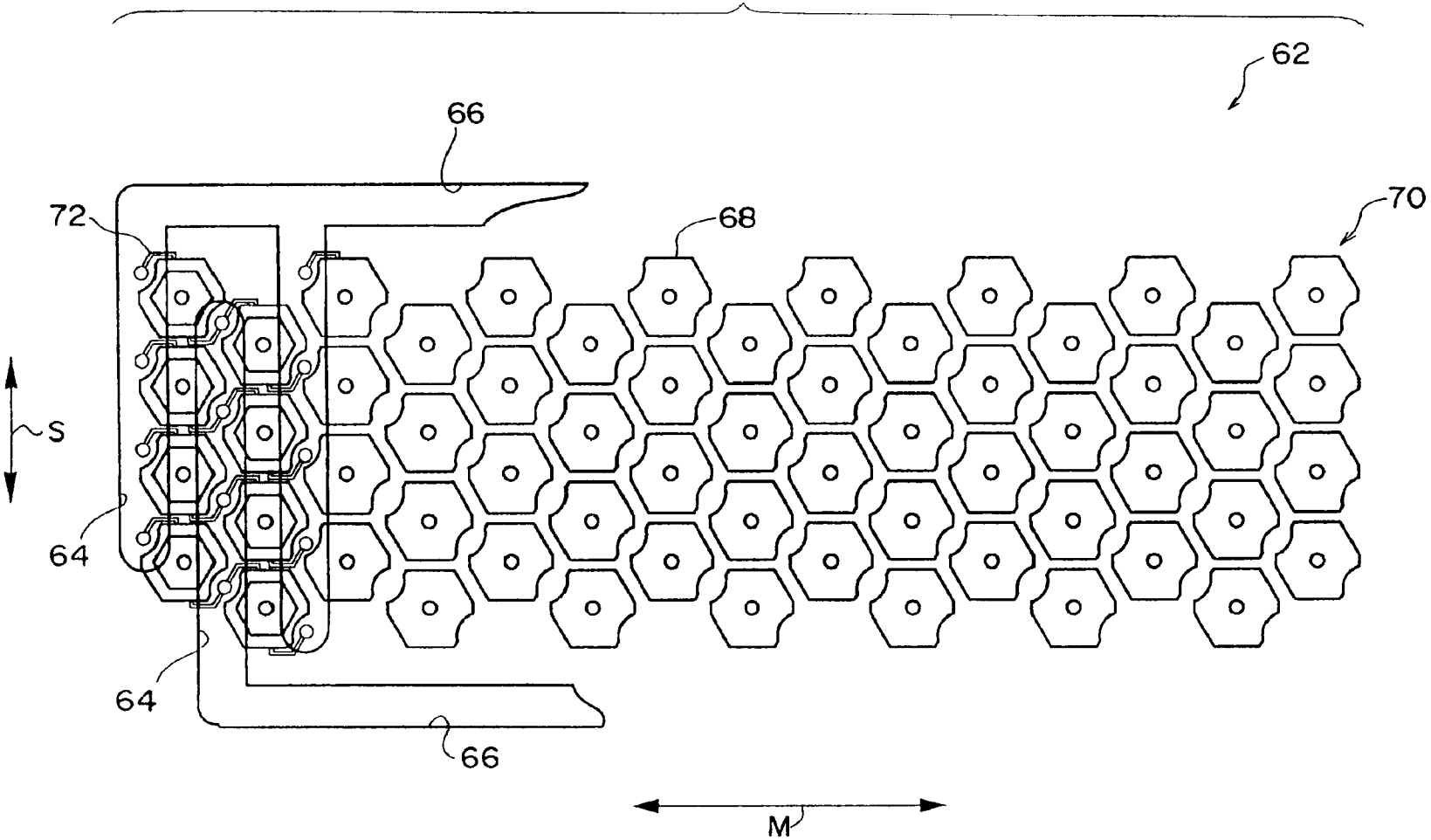
FIG. 18 PRIOR ART
FIG. 18 is a plan view to schematically show still another example of the arrangement of ejectors of the conventional matrix array liquid drop discharging head

In this comparative example, the conventional matrix array head 42 shown in FIG. 15A was prepared and an image recording was performed in the same way by the use of a liquid drop discharging device provided with this matrix array head 42.

As a result, the recorded image had noticeable variations in the print density of about 0.8 mm intervals (space frequency of 1.2 cycle/mm) and hence was significantly reduced in uniformity. That is, in the arrangement of ejectors shown in FIG. 15A, the dots were arranged in the order of the ejectors 138A, 138B, 138C, 138D, 138E, 138F, 138G, and 138H and hence the cycle of variations in the print density became 10 times that in the present embodiment. Therefore, the space frequency of variations in the print density was brought into a range easily sensed by the human eyes.

Since the invention has the construction described above, it is possible to reduce variations in the print density easily caused by the matrix array head without reducing a recording speed and hence to realize compatibility between recording images at high speeds and recording images at high quality levels.

What is claimed is:

1. A liquid drop discharging head comprising a plurality of ejector units arranged along a main scanning direction, wherein:

each ejector unit includes a first ejector group arranged at one side in the main scanning direction and a second ejector group arranged at another side in the main scanning direction;

each ejector group includes a plurality of ejectors;

all of the ejectors are arranged two-dimensionally in a predetermined plane;

each ejector group is formed of ejectors arranged two-dimensionally in the plane;

each ejector includes at least one nozzle;

a common passage provided in each ejector group to supply the ejectors with ink;

the nozzles of each ejector group are alternately arranged so that when viewed in the main scanning direction, a nozzle of one ejector of the first ejector group is followed by a nozzle of one ejector of the second ejector group, and alternates this order along a sub-scanning direction; and the ejectors in each ejector group are disposed such that an imaginary line connecting the ejectors is substantially parallel to the corresponding common passage to supply the ejectors with ink and is inclined at a predetermined angle with respect to the sub-scanning direction.

2. A liquid drop discharging head as claimed in claim 1, further comprising a piezoelectric actuator for discharging a liquid drop.

3. A liquid drop discharging head as claimed in claim 1, wherein each nozzle includes a liquid discharge passage, a communication passage, and a liquid discharge port.

4. A liquid drop discharging head as claimed in claim 1, wherein each ejector includes a nozzle and a pressure generation chamber.

5. A liquid drop discharging head as claimed in claim 1, wherein in each of the common passages, one end is closed and another end is connected to one same second common passage.

6. A liquid drop discharging head as claimed in claim 5, wherein the second common passage extends parallel to the sub-scanning direction, has one liquid supply port at one end side thereof, and is connected to a liquid supply source through the liquid supply port.

7. A liquid drop discharging head as claimed in claim 1, wherein all of the ejectors in each ejector unit together form a sawtooth shape when viewed in a plan view.

8. A liquid drop discharging head as claimed in claim 1, wherein all of the ejectors in each ejector unit together form a letter V shape.

9. A liquid drop discharging head as claimed in claim 1, wherein in each ejector unit, all of the ejectors of the first ejector group are connected to each other through one common passage and all of the ejectors of the second ejector group are connected to each other through another common passage.

10. A liquid drop discharging head as claimed in claim 9, wherein in the one common passage, one end is closed and another end is connected to one second common passage, and wherein in the another common passage, one end is closed and another end is connected to another second common passage.

11. A liquid drop discharging head as claimed in claim 10, wherein each of the one second common passage and the another second common passage extends parallel to the sub-scanning direction, has one liquid supply port at one end side thereof, and is connected to a liquid supply source through the liquid supply port.

12. A liquid drop discharging head as claimed in claim 10, wherein the one second common passage and the another second common passage are disposed outside of the ejector unit.

13. A liquid drop discharging head as claimed in claim 10, wherein the one second common passage and the another second common passage are disposed so as to cross the ejector unit.

14. A liquid drop discharging head as claimed in claim 9, wherein in each of the one common passage and the another common passage, one end is closed and another end is connected to one same second common supply passage.

15. A liquid drop discharging head as claimed in claim 14, wherein the second common passage extends parallel to the sub-scanning direction, has one liquid supply port at one end side thereof, and is connected to a liquid supply source through the liquid supply port.

16. A liquid drop discharging head as claimed in claim 14, wherein the second common passage extends parallel to the sub-scanning direction, has one liquid supply port nearly at a center thereof, and is connected to a liquid supply source through the liquid supply port.

17. A liquid drop discharging device, comprising:

a liquid drop discharging head for applying a liquid drop to an object;

a main scanning mechanism for relatively moving the object and the liquid drop discharging head in a main scanning direction, wherein the liquid drop discharging head includes at least one ejector unit arranged along the main scanning direction;

each ejector unit including a first ejector group arranged at one side in the main scanning direction and a second ejector group arranged at another side in the main scanning direction;

each ejector group includes a plurality of ejectors;

all of the ejectors are arranged two-dimensionally in a predetermined plane;

each ejector includes one nozzle;

a common passage provided in each ejector group to supply the ejectors with ink;

the nozzles of each ejector group are alternately arranged so that when viewed in the main scanning direction, a nozzle of one ejector of the first ejector group is followed by a nozzle of one ejector of the second ejector group, and alternates this order along a sub-scanning direction; and the ejectors in each ejector group are disposed such that an imaginary line connecting the ejectors is substantially parallel to the corresponding common passage to supply the ejectors with ink and inclined at a predetermined angle with respect to the sub-scanning direction, wherein the imaginary line is defined by connecting all of the ejectors in each ejector group.

18. A liquid drop discharging device as claimed in claim 17, further comprising a sub-scanning mechanism for relatively moving the object and the liquid drop discharging head in the sub-scanning direction.

19. A liquid drop discharging device as claimed in claim 17, further comprising a piezoelectric actuator for discharging a liquid drop.

20. A liquid drop discharging head comprising a plurality of ejector units arranged along a main scanning direction, wherein:

each ejector unit includes a first ejector group arranged at one side in the main scanning direction and a second ejector group arranged at another side in the main scanning direction;

each ejector group includes a plurality of ejectors;

all of the ejectors are arranged two-dimensionally in a predetermined plane;

each ejector group is formed by ejectors arranged two-dimensionally in the plane;

each ejector includes at least one nozzle;

a common passage provided in each ejector group;

the nozzle of each ejector group are alternately arranged so that when viewed in the main scanning direction, a nozzle of one ejector of the first ejector group is followed by a nozzle of one ejector of the second ejector group, and alternates this order along a sub-scanning direction;

a first imaginary line defined by connecting all of the ejectors in the first ejector group and inclined at a first angle with respect to the sub-scanning direction;

a second imaginary line defined by connecting all of the ejectors in the second ejector group and inclined at a second angle with respect to the sub-scanning direction, wherein the first imaginary line and the second imaginary line are substantially parallel to the corresponding common passage, and the first angle and the second angle are substantially the same.

* * * * *